US008756864B2

(12) United States Patent
Hamaker et al.

(10) Patent No.: US 8,756,864 B2
(45) Date of Patent: Jun. 24, 2014

(54) SLIDE DOOR

(75) Inventors: Larry Hamaker, Raleigh, NC (US); Prasad Sahasrabudhe, Newington, CT (US); Michael A. Zabbo, Columbia, CT (US); Vito A. Spinelli, Shelton, CT (US); Thomas M. Kowalczyk, Unionville, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 0 days.

(21) Appl. No.: 13/234,801

(22) Filed: Sep. 16, 2011

(65) Prior Publication Data

US 2012/0073205 A1 Mar. 29, 2012

Related U.S. Application Data

(60) Provisional application No. 61/384,193, filed on Sep. 17, 2010, provisional application No. 61/480,712, filed on Apr. 29, 2011.

(51) Int. Cl.
*E06B 3/32* (2006.01)

(52) U.S. Cl.
USPC ..... 49/143; 49/163; 49/168; 49/142; 49/125

(58) Field of Classification Search
USPC ..... 49/158, 159, 160, 163, 164, 166, 168, 49/142, 143, 125, 128, 129, 130, 323
See application file for complete search history.

(56) References Cited

U.S. PATENT DOCUMENTS

| | | | | | |
|---|---|---|---|---|---|
| 3,300,897 | A | | 1/1967 | Wikkerink | |
| 3,318,047 | A | | 5/1967 | Carson | |
| 3,354,581 | A | | 11/1967 | Dimmitt et al. | |
| 3,466,805 | A | | 9/1969 | Muessel | |
| 3,491,483 | A | * | 1/1970 | Miller | 49/141 |
| 4,305,227 | A | | 12/1981 | Georgelin | |
| 4,438,594 | A | * | 3/1984 | Bunzl | 49/177 |
| 4,503,637 | A | | 3/1985 | Parente | |
| 4,619,074 | A | * | 10/1986 | Leung et al. | 49/143 |
| 5,417,272 | A | * | 5/1995 | Marlowe et al. | 160/202 |
| 5,832,980 | A | * | 11/1998 | Cianciolo | 160/197 |
| 5,908,064 | A | * | 6/1999 | Bruce | 160/202 |
| 6,061,961 | A | | 5/2000 | Rupe | |
| 6,161,334 | A | * | 12/2000 | Goodin | 49/125 |

(Continued)

FOREIGN PATENT DOCUMENTS

JP 2009-215822 9/2009

*Primary Examiner* — Jerry Redman
(74) *Attorney, Agent, or Firm* — Richard J. Veltman; Adan Ayala

(57) ABSTRACT

A slideable and pivotable door assembly configured to selectively permit passage through an opening between a first side and a second side of the opening. The slideable and pivotable door assembly has a normally fixed door panel arranged to cover a first portion of the opening when in a normally closed fixed position. The door assembly also includes a slideable door panel slidable relative to the fixed door panel. The slideable door panel is slidable between a 1) closed position wherein the door panel covers a second portion of the opening and 2) an open position wherein the second portion of the opening is uncovered. A first pivot structure enables pivotal movement of the normally fixed door panel upon a pivoting actuation and a second pivot structure enables pivotal movement of the slideable door panel at any position relative to the normally fixed door panel while the normally fixed door panel remains in its normally fixed position.

20 Claims, 23 Drawing Sheets

(56) References Cited

U.S. PATENT DOCUMENTS

| | | | | |
|---|---|---|---|---|
| 6,170,195 | B1 * | 1/2001 | Lim | 49/196 |
| 6,422,287 | B1 | 7/2002 | Wilke | |
| 6,526,695 | B1 | 3/2003 | Nguyen | |
| 6,973,753 | B2 | 12/2005 | Liebscher | |
| 7,117,637 | B2 | 10/2006 | Delgado et al. | |
| 7,222,457 | B2 | 5/2007 | Delgado et al. | |
| 7,296,608 | B2 | 11/2007 | Weishar et al. | |
| 7,451,802 | B2 * | 11/2008 | Cianciolo et al. | 160/211 |
| 7,458,410 | B1 * | 12/2008 | Bronner | 160/197 |
| 7,950,439 | B2 * | 5/2011 | Anderson | 160/211 |
| 8,096,342 | B2 * | 1/2012 | Scruggs | 160/211 |
| 2004/0025455 | A1 | 2/2004 | Nubel et al. | |
| 2004/0107642 | A1 | 6/2004 | Liebscher | |
| 2006/0101718 | A1 | 5/2006 | Fronz et al. | |
| 2006/0150512 | A1 | 7/2006 | Heithe et al. | |
| 2007/0144070 | A1 | 6/2007 | Delgado et al. | |
| 2007/0234641 | A1 | 10/2007 | Delgado et al. | |
| 2008/0250716 | A1 | 10/2008 | Ranaudo et al. | |
| 2010/0242366 | A1 * | 9/2010 | Liebscher et al. | 49/142 |

* cited by examiner

SLIDE DOOR

CROSS-REFERENCE TO RELATED APPLICATIONS

This application claims priority and benefit under 35 U.S.C. §119(e) to U.S. Provisional Patent Application No. 61/384,193, entitled "Slide Door", filed on Sep. 17, 2010 and U.S. Provisional Patent Application No. 61/480,712, entitled "Slide Door", filed on Apr. 29, 2011. The contents of these applications are incorporated herein in their entirety by reference.

BACKGROUND OF THE INVENTION

1. Field of the Invention

The present invention relates to a sliding door assembly that includes a normally fixed door panel, a sliding door panel, and breakaway features that enables the sliding door panel and/or the normally fixed door panel to move to a breakaway configuration.

2. Background of the Invention

Sliding door assemblies generally include a frame assembly with at least one fixed or non-sliding door panel mounted thereto and at least one sliding door panel that moves in a generally rectilinear manner between opened and closed positions. In the open position, the sliding door panel and the non-sliding door panel are generally in at least a partially overlapping configuration wherein passage through the door assembly is permitted. In the closed position, the sliding door panel and the non-sliding door panel are arranged on the frame assembly such that passage through the door assembly is prevented.

The sliding door panel may be moved between the open and closed positions manually. Manual doors are often used in Intensive Care Units (ICUs) and other locations. Oftentimes, the sliding door panel and the non-sliding door panel are provided with the capability to open outwardly in a swinging manner under an application of a force (e.g., manual force) to allow persons to pass through the door assembly during certain conditions (e.g., if the slideable door panel cannot be slid to the open position). This capability, referred to in the art as "breakout" or "breakaway," is often required by state or local building codes as a measure for facilitating exit from buildings in certain situations. This breakaway feature permits the door panels to be pivotally swung open about a pivot axis.

Each of the individual door panels (sliding door panels and fixed/non-sliding door panel) are typically configured to pivot to the breakaway position separately about their own pivot axis (i.e., there are individual pivot axes for each door panel). The sliding door panel and the non-sliding door panel are typically arranged such that the pivoting action of the door assembly is permitted only when the sliding door panel is fully in the open position.

The present invention provides several improvements over the prior art.

SUMMARY OF THE INVENTION

One aspect of the present invention provides a slideable and pivotable door assembly configured to selectively permit passage through an opening between a first side and a second side of the opening. The slideable and pivotable door assembly includes a normally fixed door panel having a normally closed fixed position. The fixed door panel is arranged to cover a first portion of the opening when in its normally closed fixed position. The door assembly also includes a slideable door panel that is constructed and arranged to be slidable relative to the fixed door panel. The slideable door panel is slidable between a 1) closed position wherein the door panel covers a second portion of the opening and 2) an open position wherein the second portion of the opening is uncovered. The door assembly further includes a first pivot structure constructed and arranged to enable pivotal movement of the normally fixed door panel upon a pivoting actuation. The door assembly also includes a second pivot structure constructed and arranged to enable pivotal movement of the slideable door panel while the normally fixed door panel remains in its normally fixed position.

Another aspect of the present invention provides a slideable and pivotable door assembly configured to selectively permit passage through an opening between a first side and a second side of the opening. The slideable and pivotable door assembly includes a normally fixed door panel having a normally closed fixed position. The fixed door panel is arranged to cover a first portion of the opening when in its normally closed fixed position. The fixed door panel also includes a slideable door panel constructed and arranged to be slideable relative to the fixed door panel. The slideable door panel is slidable between a 1) closed position wherein the slideable door panel covers a second portion of the opening and 2) an open position wherein the second portion of the opening is uncovered. The door assembly also includes a first pivot structure constructed and arranged to enable pivotal movement of the normally fixed door panel when the slideable door panel is disposed at a predetermined orientation relative to the fixed door panel. The door assembly further includes a second pivot structure constructed and arranged to enable pivotal movement of the slideable door panel at any slideable position of the slideable door panel.

These and other aspects of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated can be considered drawn to scale. It is to be expressly understood, however, that the drawings are for the purpose of illustration and description only and are not intended as a definition of the limits of the invention. It shall also be appreciated that the features of one embodiment disclosed herein can be used in other embodiments disclosed herein. As used in the specification and in the claims, the singular form of "a", "an", and "the" include plural referents unless the context clearly dictates otherwise.

DETAILED DESCRIPTION OF THE INVENTION

Figure 1A:
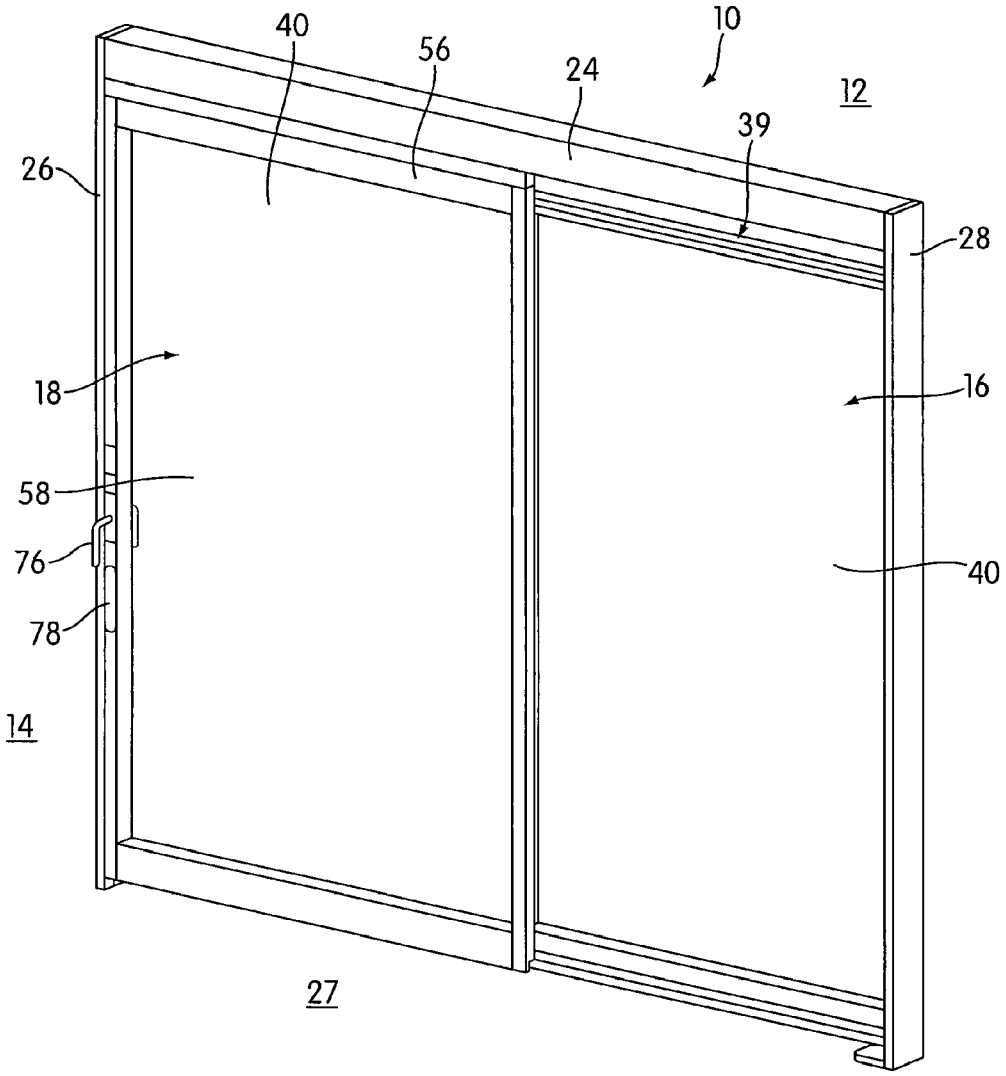
FIG. 1A is a perspective view of a door assembly 10 in a closed position in accordance with an embodiment.
Figure 1B:
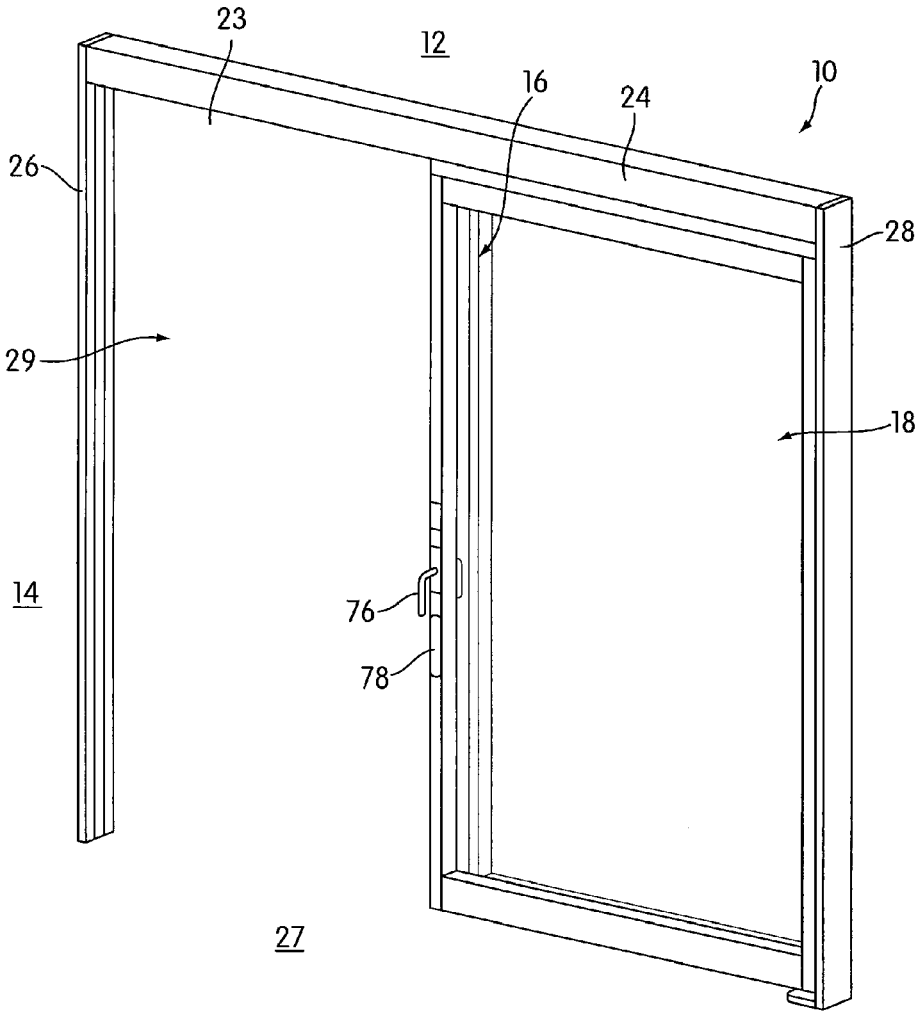
FIG. 1B is a perspective view of the door assembly in an open position in accordance with an embodiment.

FIG. 1A illustrates a slideable and pivotable door assembly 10. The door assembly 10 is configured to permit or prevent passage between a first side 12 and a second side 14 through an opening 29 (see FIG. 1B). Referring to FIG. 1A, the slideable and pivotable door assembly 10 includes a normally fixed (non-sliding) door panel 16 having a normally closed fixed position and a slideable door panel 18 constructed and arranged to be slideable relative to the normally fixed door panel 16. The fixed door panel 16 is arranged to cover a first portion 21 (see FIG. 1C) of the opening 29 (see FIG. 1C) when in its normally closed fixed position. The slideable door panel 18 is slideable between 1) a closed position (shown in FIG. 1A) wherein the door panel covers a second portion 23 (see FIG. 1C) of the opening 29 and 2) an open position (see FIG. 1B) wherein the second portion 23 of the opening 29 is uncovered. In the open position, the slideable door panel 18 and the normally fixed door panel 16 may be in a substantially or completely overlapping configuration (see FIG. 1B). The assembly 10 also includes a first pivot structure 20 (see FIG. 9) constructed and arranged to enable pivotal movement of the normally fixed door panel upon a pivoting actuation. A second pivot structure 22 (see FIG. 10A) is constructed and arranged to enable pivotal movement of the slideable door panel 18 while the normally fixed door panel 16 remains in its normally fixed position.

Referring back to the embodiment shown in FIG. 1A, the door assembly 10 includes a header 24 constructed and arranged to be mounted with respect to the opening 29 formed, for example, through a wall (not shown) or barrier to which the door assembly 10 is installed. The header 24 may be made of aluminum, plastic, wood, other materials, or any combination thereof. First and second opposing door jambs 26, 28 extend generally perpendicular to the header 24 towards a lower surface 27 (e.g., floor). The normally fixed door panel 16 is normally fixed between the opposing door jambs 26, 28 and the slideable door panel 18 is constructed and arranged to slide between the open and closed positions between the opposing door jambs 26, 28. In one embodiment, the door assembly 10 is manual such that the sliding movement of the slideable door panel 18 is performed manually (e.g., with manual force).

Figure 15A:
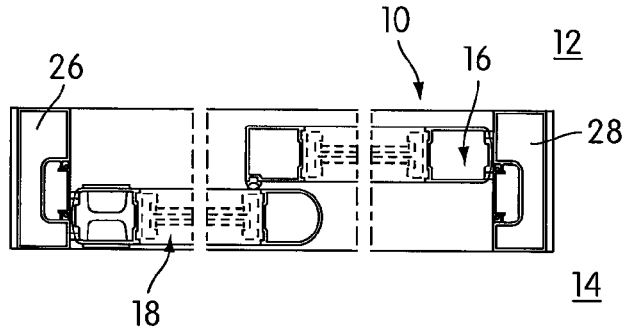
FIG. 15A is a cross sectional top view of the door assembly in the closed position in accordance with an embodiment.

In one embodiment, the slideable door panel 18 and the normally fixed door panel 16 are arranged such that the slideable door panel 18 is positioned closer than the normally fixed door panel 16 to the second side 14 (e.g., the outside) and the normally fixed door panel 16 is positioned closer than the slideable door panel 18 to the first side 12 (e.g., the inside) (see FIG. 15A). In such embodiments, the slideable door panel 18 and/or the normally fixed door panel 16 may be pivoted towards the second side 14 during breakouts (see FIGS. 2A-2B, and 1C). Such configuration enables the slideable door panel 18 to be moved to a standard breakout configuration (see FIG. 2B) wherein the slideable door panel 18 is pivoted towards the second side 14 while the normally fixed door panel 16 remains in its normally fixed position. That is, the arrangement of the slideable door panel 18 and the normally fixed panel permits 16 permits the slideable door panel 18 to be pivoted to the standard breakout configuration at any position during sliding movement between the open and closed positions without any impedance by the normally fixed door panel 16. In such embodiments, the slideable door panel 18 may be substantially perpendicular to the normally fixed door panel 16 during a standard breakout. However, this arrangement is not intended to be limiting, and the slideable door panel 18 may be at various other angles relative to the normally fixed door panel 16 during a standard breakout. The arrangement of the slideable door panel 18 and the normally fixed door panel 16 will be described in detail later.

Figure 1C:
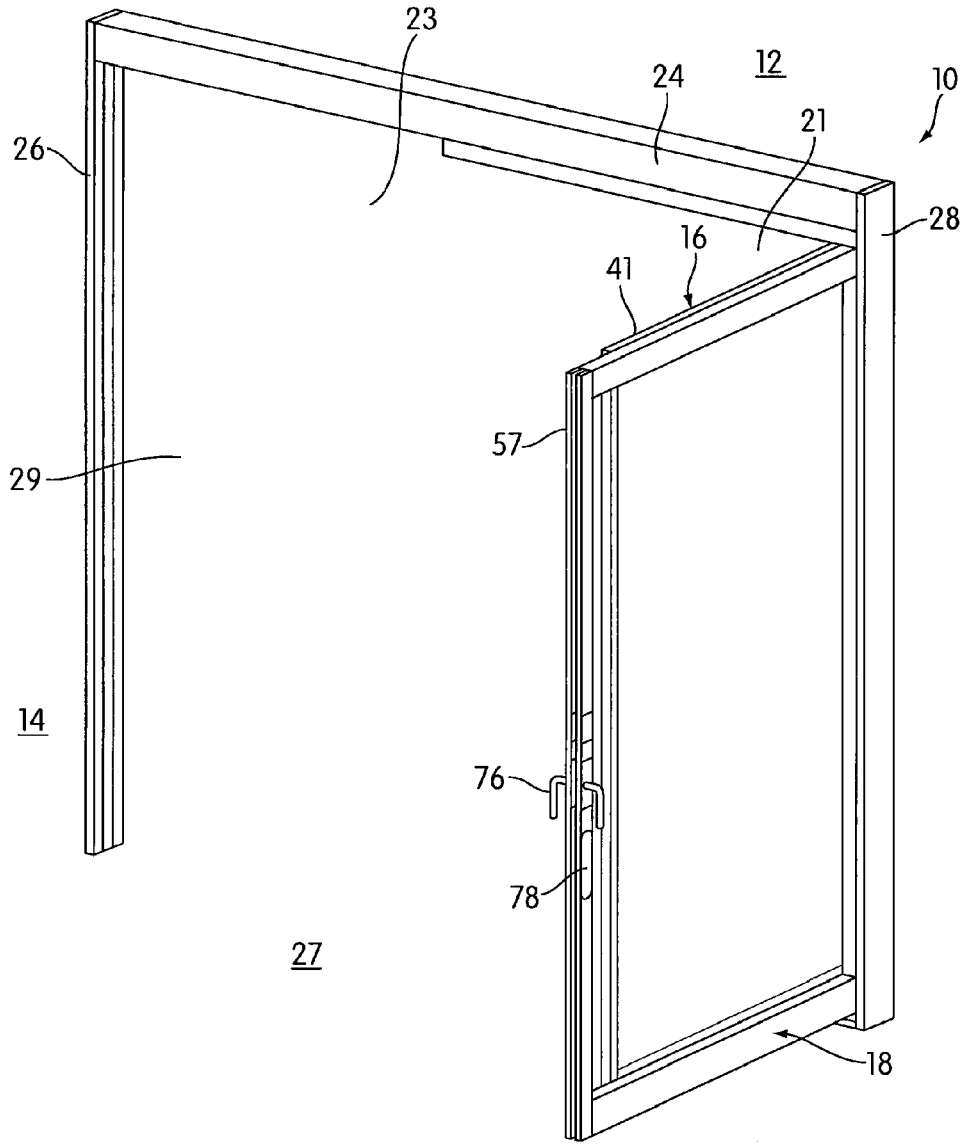
FIG. 1C is a perspective view of the door assembly in a utility breakout position in accordance with an embodiment.
Figure 2A:
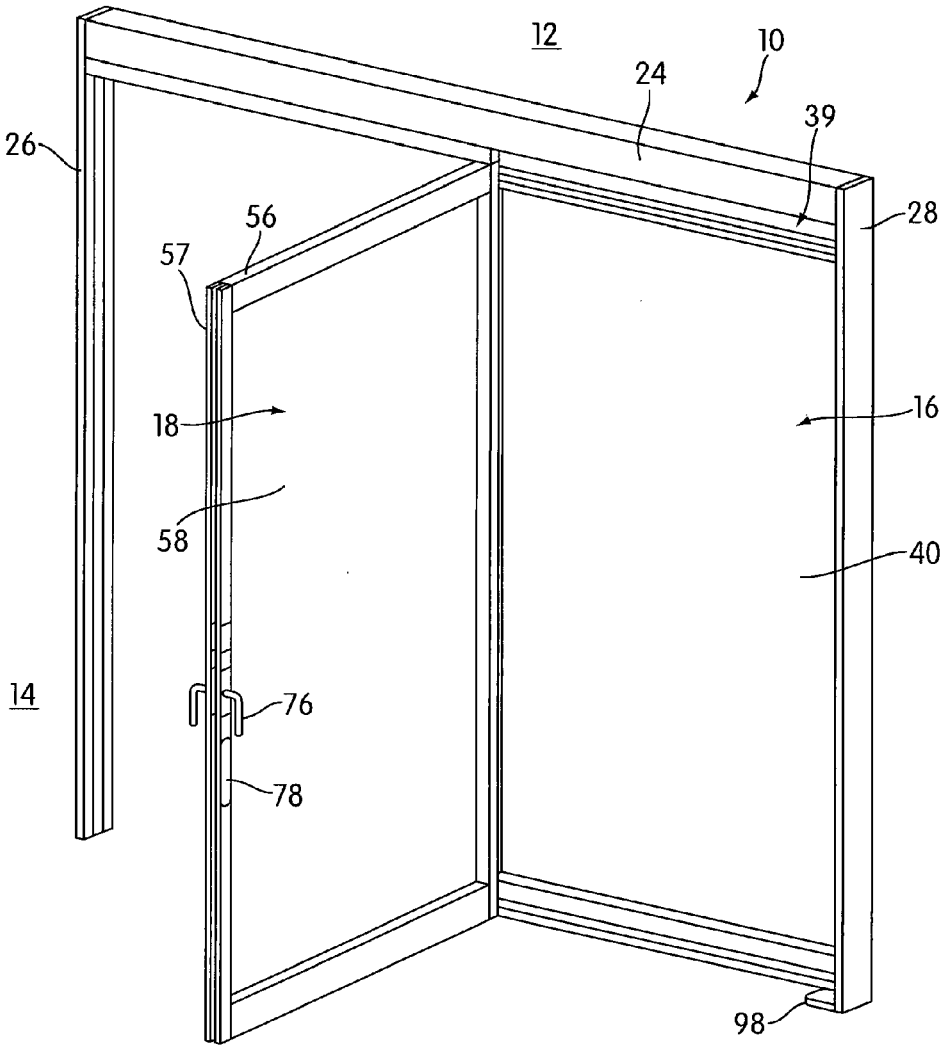
FIGS. 2A-2B are perspective views of the door assembly in a standard breakout position in accordance with an embodiment.
Figure 2B:
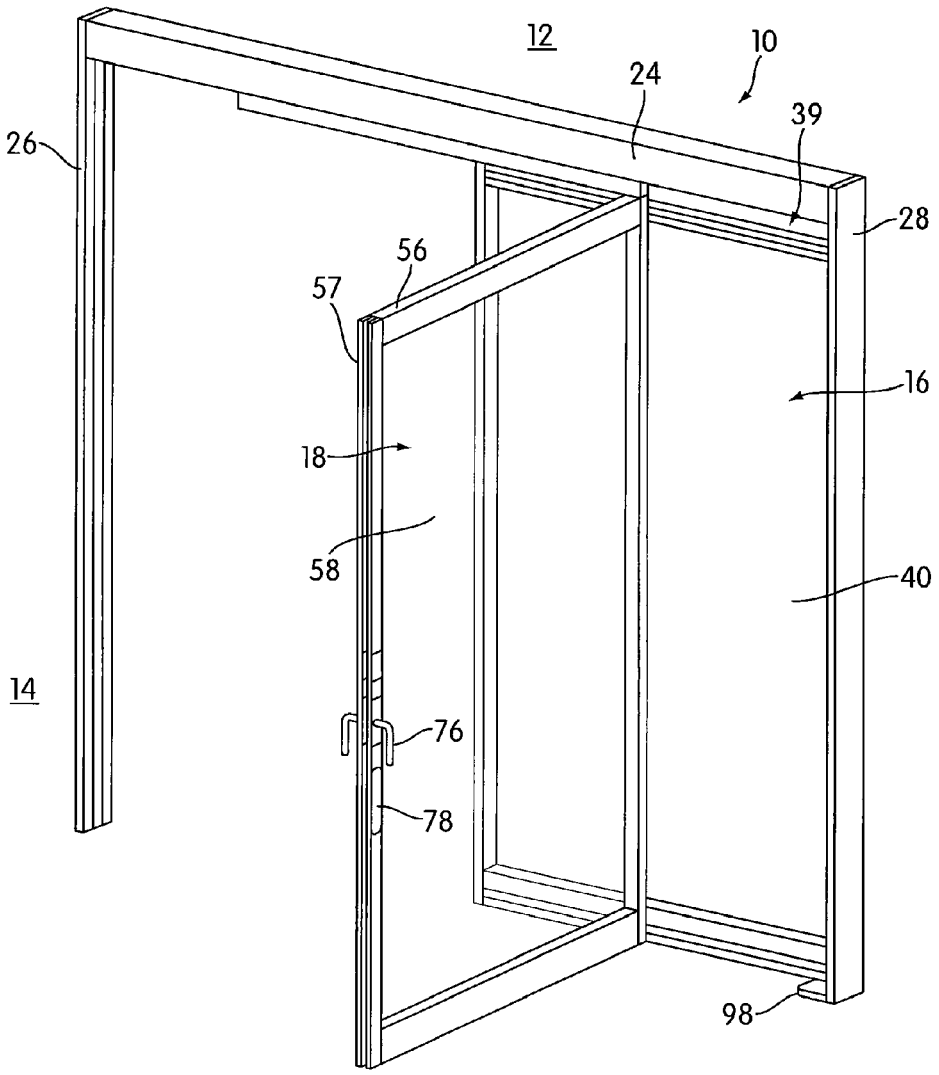

In one embodiment, the door assembly 10 includes a third pivot structure 30 (see FIG. 9) constructed and arranged to facilitate pivotal movement of the slideable door panel 19 during a utility breakout (see FIG. 1C). The door assembly 10 also includes a fourth pivot structure 31 (see FIG. 4) associated with the slideable door panel 18 and operable with either the second pivot structure 20 or the third pivot structure 30 to enable pivotal movement of the slideable door panel 18 between 1) a first position (see, for example, FIGS. 1A and 1B) wherein the slideable door panel 18 is substantially parallel to the normally fixed door panel 16 when the normally fixed door panel 16 is in the fixed position and 2) a second position (see, for example, FIGS. 1C, 2A-2B) wherein the slideable door panel 18 is pivoted towards the second side 14. A fifth pivot structure 33 (see FIG. 3) is provided in the door assembly 10 and is associated with the normally fixed door panel 16. The fifth pivot structure 33 is operable with the first pivot structure 20 to enable pivotal movement of the normally fixed door panel 16 during utility breakout.

As shown in FIG. 1C, during a utility breakout, both the normally fixed door panel 16 and the slideable door panel 18 may be pivoted towards the second side 14. In one embodiment, to move the normally fixed door panel 16 and the slideable door panel 18 to the utility breakout configuration, the normally fixed door panel 16 and the slideable door panel 18 may be pivoted about 90 degrees towards the second side 14. Accordingly, the utility breakout configuration provides a wider opening than the standard breakout configuration for passage therethrough. However, in one embodiment, the slideable door panel 18 should be engaged or aligned with the third pivot structure 30 to enable pivoting of the slideable door panel 18 and the normally fixed door panel 16 to the utility breakout configuration. In contrast, the slideable door panel 18 may be moved to the standard breakout configuration at any position (see, for example, FIGS. 2A-2B).

Figure 3:
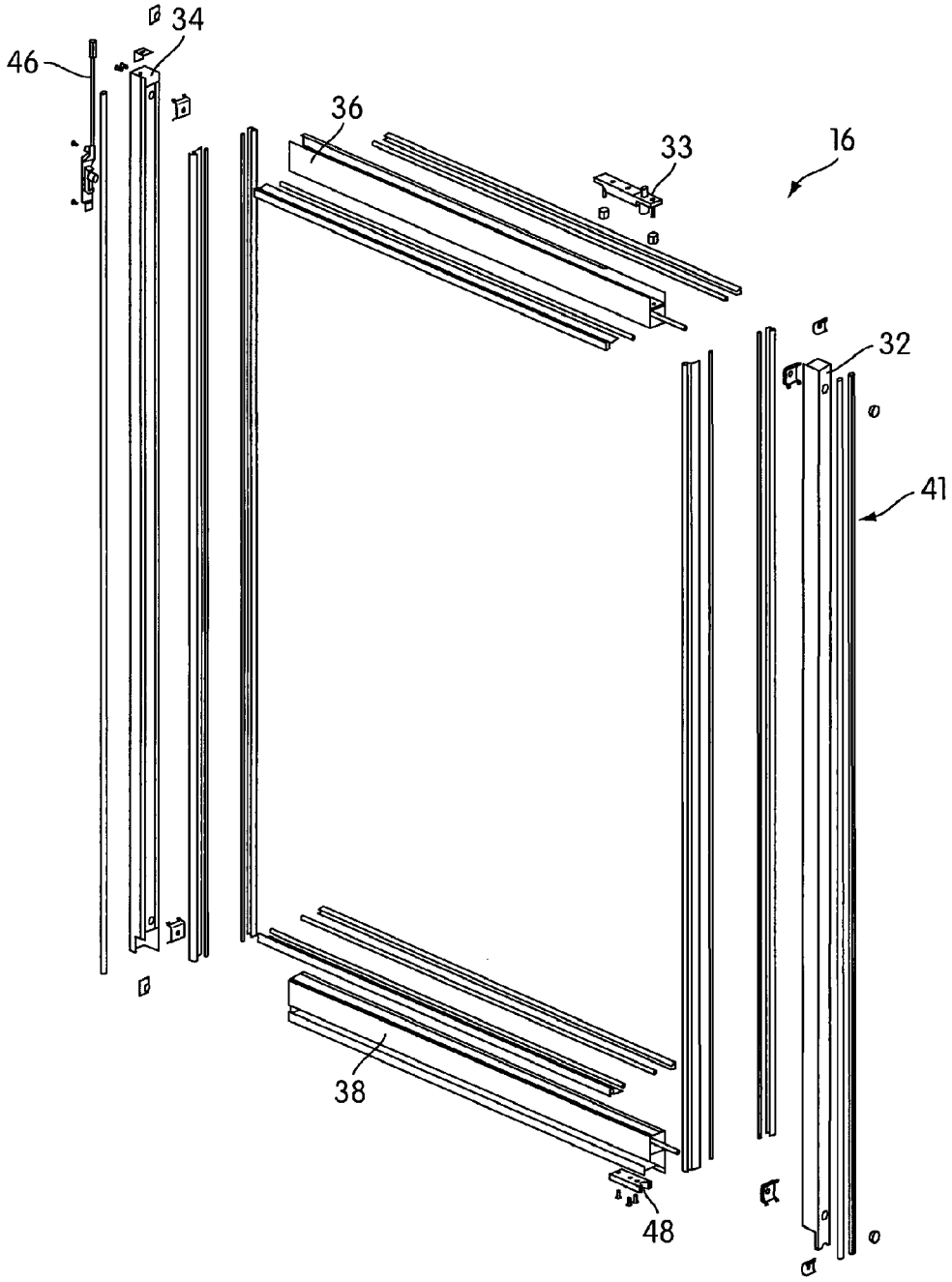
FIG. 3 is an exploded view of a normally fixed door panel of the door assembly in accordance with an embodiment.

FIG. 3 is an exploded view of the normally fixed door panel 16. In the embodiment shown in FIG. 3, the normally fixed door panel 16 is provided with a pivot stile 32 and a leading stile 34. An upper rail 36 and a lower rail 38 are constructed and arranged to be operatively connected to the pivot stile 32 and the leading 34 to form a frame 39 (see FIG. 1A) of the normally fixed door panel 16. A sheet of material 40, such as glass, plastic, or a combination thereof may be provided in the frame 39 to form the normally fixed door panel 16. The frame 39 and the sheet of material 40 may define the pivotal portion 41 (see also FIG. 1C) of the normally fixed door panel 16. Referring back to FIG. 3, a bolt or other locking structure 46 may optionally be provided to enable the slideable door panel 18 to be locked to prevent pivotal movement thereof. The normally fixed door panel 16 is also provided with a pivot engaging structure 48 near the lower rail 38. The pivot engaging structure 48 may be constructed and arranged to engage with the first pivot structure 20 to enable pivotal movement of the normally fixed door panel 16. Other components, such as, just for example, weatherstripping or seals, may also be provided on the normally fixed door panel 16.

Figure 4:
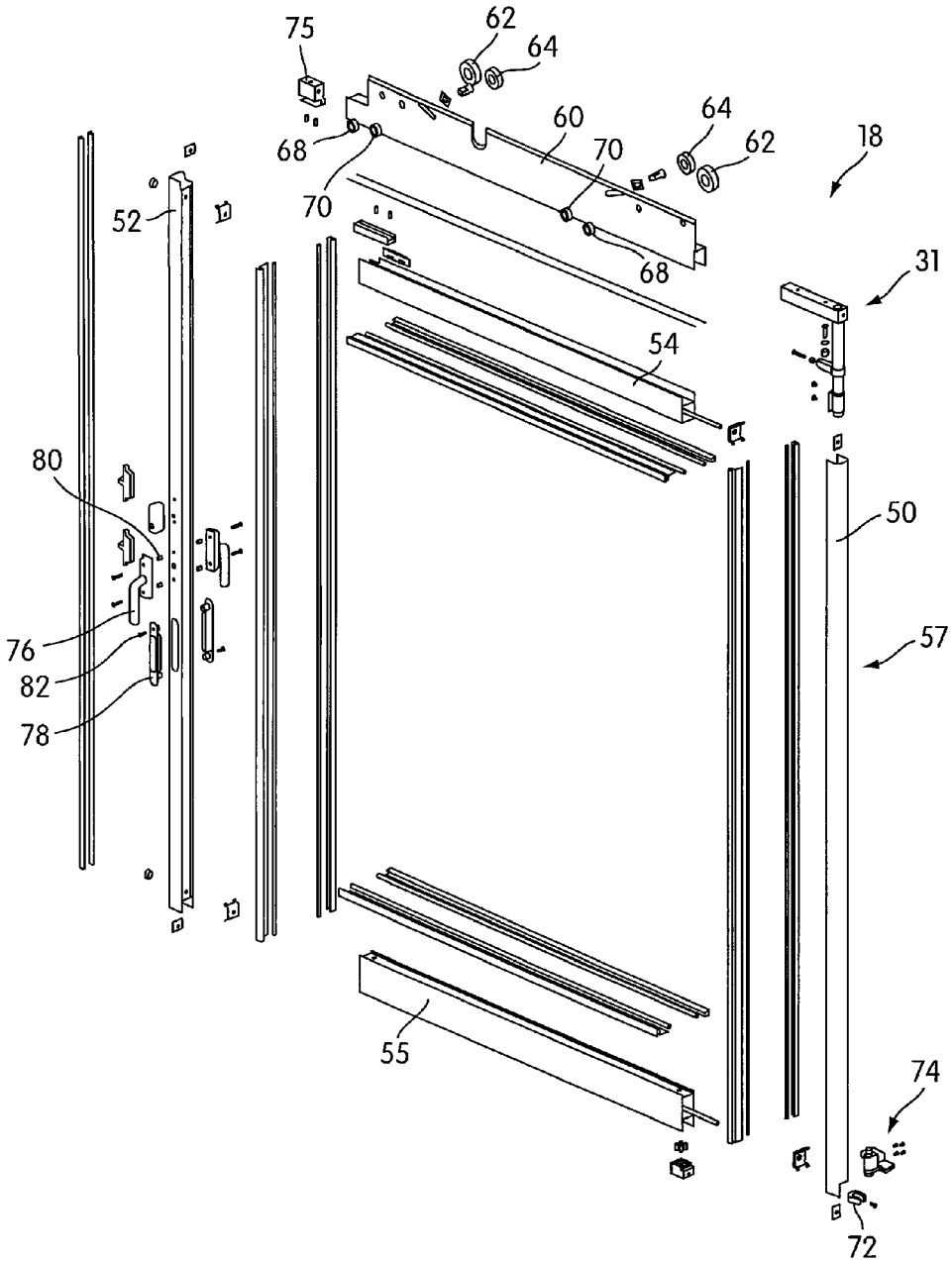
FIG. 4 is an exploded view of a slideable door panel of the door assembly in accordance with an embodiment.

FIG. 4 illustrates an exploded view of the slideable door panel 18. In the illustrated embodiment, the slideable door panel 18 includes a pivot stile 50 and a leading stile 52. The pivot stile 50 may be configured to receive at least a portion of the fourth pivot structure 31. An upper rail 54 and a lower rail 55 are constructed and arranged to be operatively connected to the pivot stile 50 and the leading stile 52 to form a frame 56 (see FIG. 1A) of the slideable door panel 18. A sheet of material 58, such as glass, plastic, or a combination thereof may be provided in the frame 56 to form the slideable door panel 18. The frame 56 and the sheet of material 58 may define the pivotal portion 57 (see also FIG. 1C) of the slideable door panel 18. Other components, such as, just for example, weatherstripping or seals, may also be provided on the slideable door panel 18.

Also shown in FIG. 4 is a hanger 60 constructed and arranged to be connected to the pivot structure 31. Rollers or load wheels 62 (two are shown in this embodiment) may be mounted to the hanger 60 using nuts 68. Anti-riser wheels 64 (two are shown in this embodiment) may also be mounted to the hanger 60 via nuts 70. The anti-riser wheels 64 may be constructed and arranged to position the slidable door panel 18 with respect to the header 24. It should be appreciated that other attachment mechanisms may be used and the number and location of the wheels 62, 64 may vary in other embodiments.

In the illustrated embodiment, a pivot engaging structure 72 is provided on the pivot stile 50 and is constructed and arranged to engage with the third pivot structure 30 to facilitate the pivoting of the slideable door panel 18 during utility breakout. A connector structure 74 may be constructed and arranged to prevent the slideable door panel 18 and the normally fixed door panel 16 from being spaced less than a predetermined minimum distance apart when the slideable door panel and the normally fixed door panel are in a substantially overlapping configuration. That is, the connector structure 74 may be constructed and arranged to provide a minimum distance between the slideable door panel 18 and the normally fixed door panel 16 when the door panels 16, 18 are in a substantially overlapping relationship. The connector structure 74 will be described in more detail later.

A handle 76 may be provided on the slideable door panel 18 to facilitate the pivoting thereof. A lock (not shown) may be provided in the handle 76 and may be constructed and arranged to lock or latch the slideable door panel 18 to prevent sliding movement thereof. For example, in one embodiment, the slideable door panel 18 may be latched or locked to the door jamb 26 using the handle 76. The handle 76 may be pivoted between a locked position wherein movement of the slideable door panel 18 is prevented and an 2) unlocked position wherein movement of the slideable door panel 18 is permitted. A recessed pull handle 78 may also be provided to facilitate the sliding movement of the slideable door panel between the open and closed positions. The handles 76, 78 may be attached to the leading stile 52 via screws 80, although it is contemplated that other attachment mechanisms may be used in other embodiments. A detent assembly 75 may be provided in the hanger 60 to help retain and position the pivotal portion 57 (defined by the frame 56 and the sheet of material 58) with respect to the hanger 60.

Figure 5:
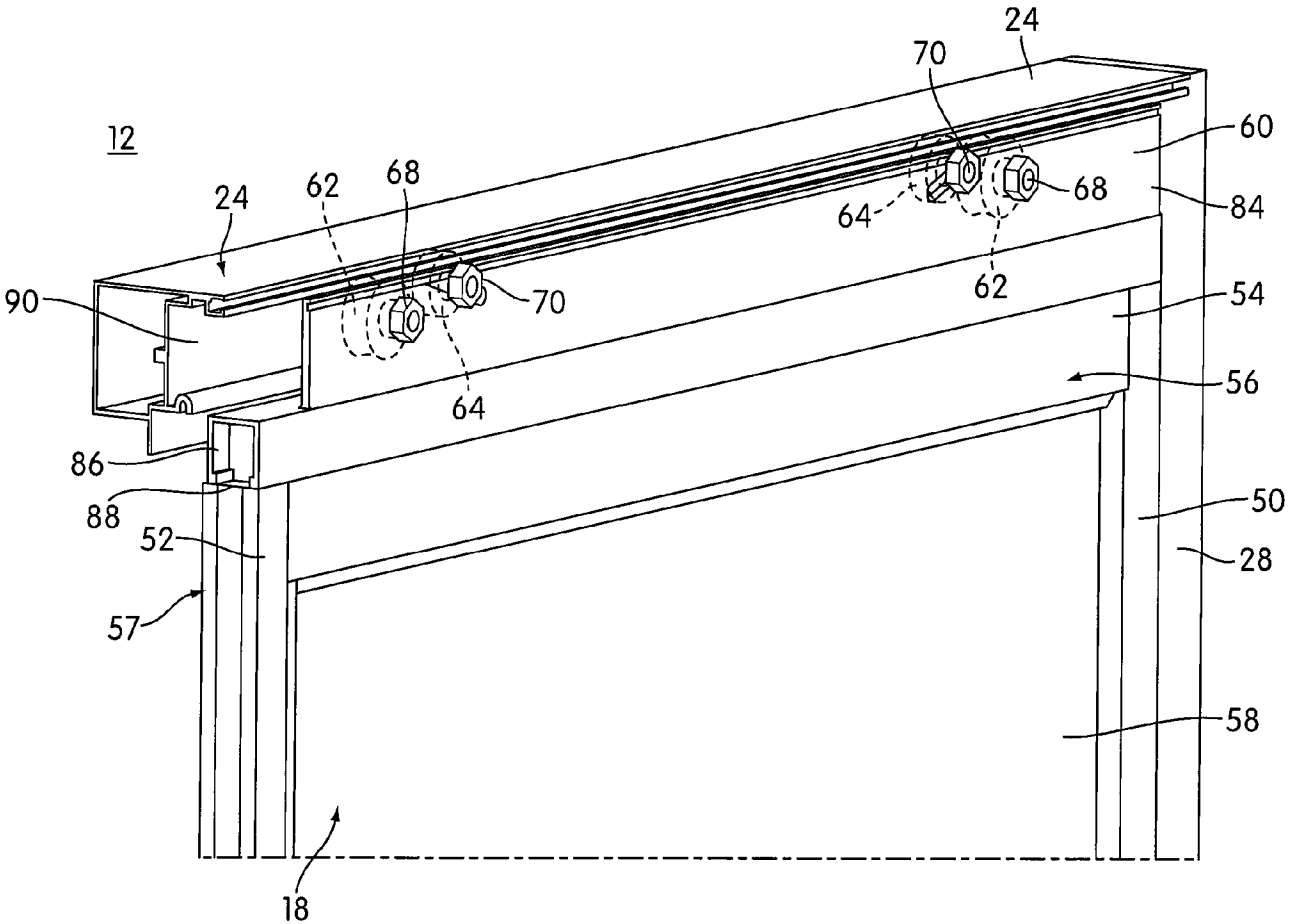
FIG. 5 is a detailed view of components of the slideable door panel and a header in accordance with an embodiment.
Figure 6:
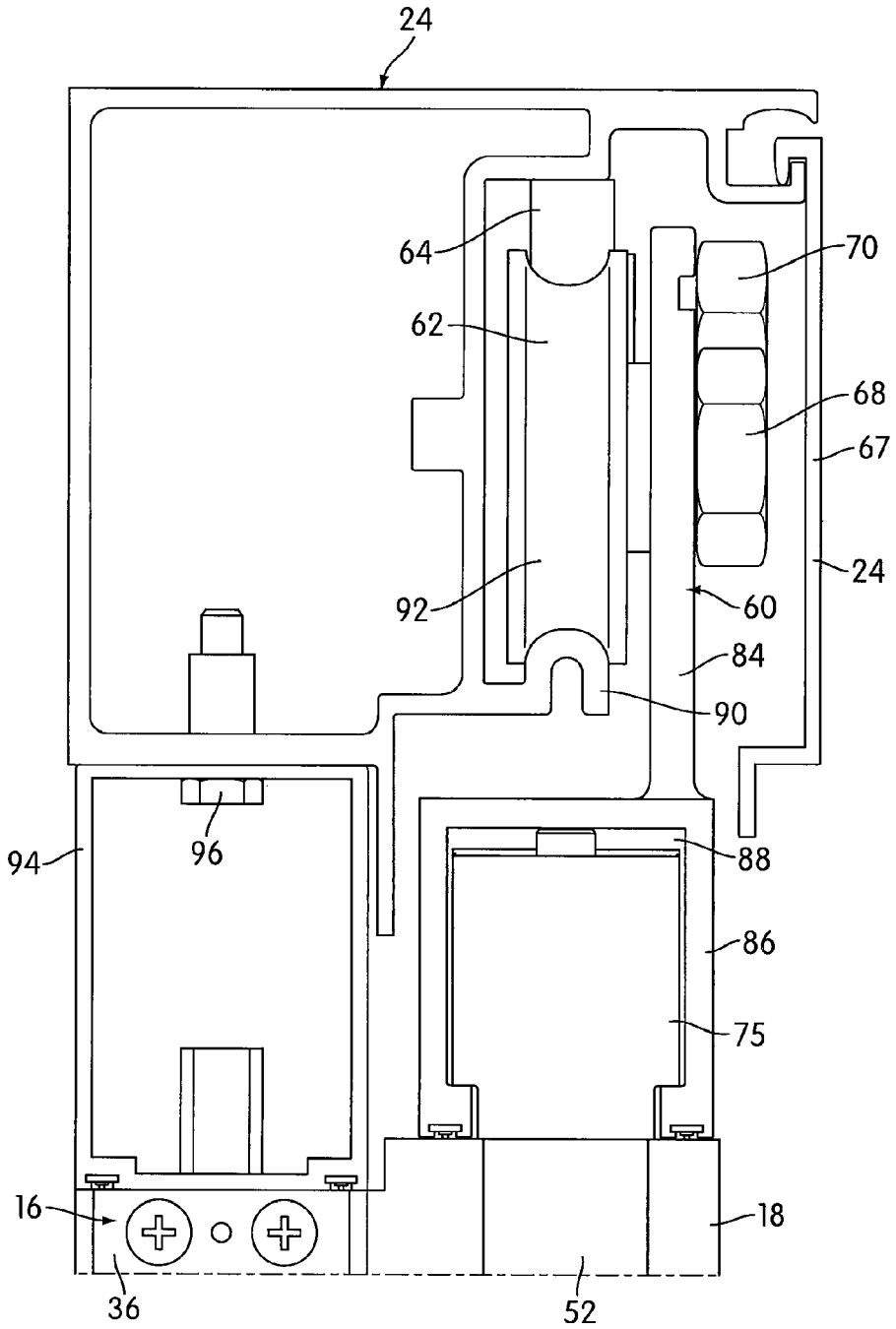
FIG. 6 shows a cross sectional side view of components of the slideable door panel in accordance with an embodiment.

In the embodiment shown in FIG. 5, the hanger 60 includes an upper portion 84 and a lower portion 86. The load wheels or rollers 62 and the anti-riser wheels 64 are mounted on the upper portion 84 of the hanger 60. The hanger 60 may be provided with openings (not shown) constructed and arranged to receive at least portions of the load wheels 62. The nuts 68 may be provided on the other side of the hanger 60 opposite the load wheels 62 to facilitate the mounting of the load wheels 62 on the hangers 60. The load wheels 62 may be made of a nylon material with stainless steel ball bearing centers, although it is contemplated that other materials may be used. In one embodiment, the lower portion 86 of the hanger 60 includes a reverse U-shaped configuration that is constructed and arranged to be disposed on portions of the upper rail 54, the pivot stile 50, and the leading stile 52 when the slideable door panel 18 is in the first (unpivoted) position. As shown in FIG. 6, the lower portion 86 may include an interior space 88 constructed and arranged to receive the detent assembly 75 and the fourth pivot structure 31 (obstructed from view in this Figure).

Referring back to the embodiment shown in FIG. 5, the header 24 includes a lower ledge or track 90 having a reverse U-shaped configuration extending along the length of the header 24. As shown in more detail in FIG. 6, the lower track 90 is constructed and arranged to engage with the load wheel 62. For example, in the illustrated embodiment, each load wheel 62 is provided with a curved contact surface 92 constructed and arranged to receive the lower track 90 of the header 24. Such an arrangement between the load wheels 62 and the lower track 90 enables the slideable door panel 18 to slide between the open and closed positions. The anti-riser wheels 64 are constructed and arranged to contact portions of the header so as to maintain the position of the hanger 60 relative to the header 24 such that the load wheels 62 may slide along the lower track 90. This configuration enables the slideable door panel 18 to slide without the use of a track. Thus, the door assembly 10 may be considered a "trackless" door assembly in one embodiment. However, a track system may also be provided in other embodiments.

In the embodiment shown in FIG. 6, a fixed rail 94 is connected to the header 24. The fixed rail 94 is constructed and arranged to be disposed on top of the upper rail 36 of the normally fixed door panel 16 when the normally fixed door panel 16 is in its fixed position. The fixed rail 94 may be attached to the header 24 via a screw and nut assembly 96 or other attachment mechanisms. In contrast to the hanger 60 that is slideable with respect to the header 24, the fixed rail 94 is fixed to the header 24 and thus is immovable. Accordingly, the normally fixed door panel 16 associated with the fixed rail 94 is in a normally fixed position and the slideable door panel 18 with the hanger 60 is slideable between the open and closed positions with respect to the normally fixed door panel 16. A header cover 67 may be provided to partially enclose at least a portion of the hanger 60 and the wheels 62, 64 in the header 24.

Figure 7:
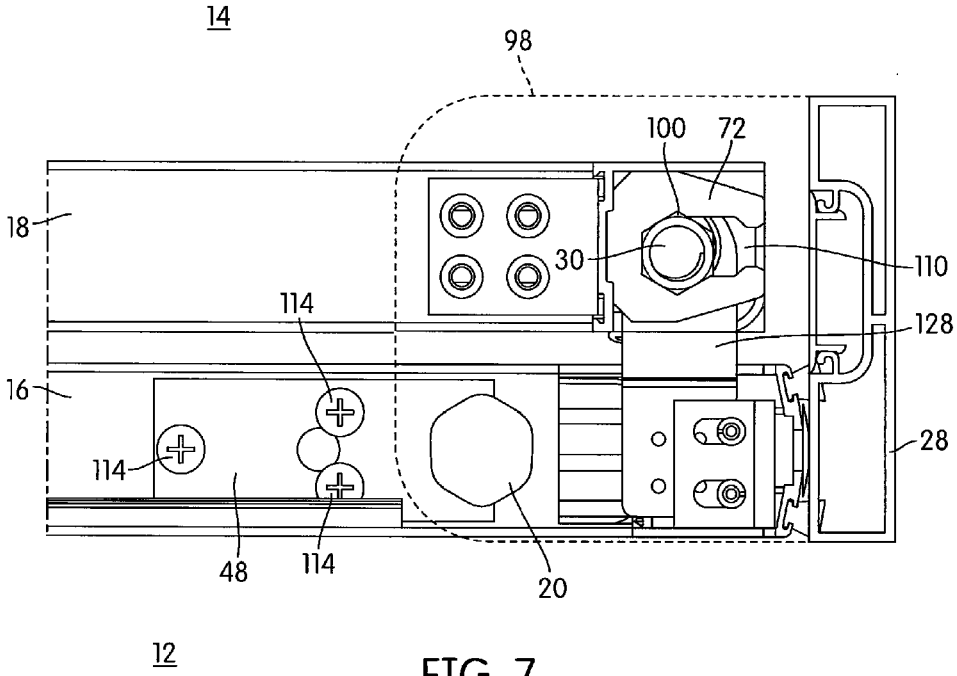
FIG. 7 shows a cross sectional view of the slideable door panel, fixed door panel, a first pivot structure, and a third pivot structure in accordance with an embodiment.

FIG. 7 illustrates a bottom view of the first pivot structure 20 and the third pivot structure 30. As mentioned above, the first pivot structure 20 is constructed and arranged to enable pivotal movement of the normally fixed door panel 16 during utility breakout. The third pivot structure 30 is constructed and arranged to facilitate pivotal movement of the slideable door panel 18 during utility breakout. Although the slideable door panel 18 may also pivot using the second pivot structure 22, the third pivot structure 30 is constructed and arranged to facilitate a more stable pivotal movement during breakout, which will be described in more detail later.

Figure 15B:
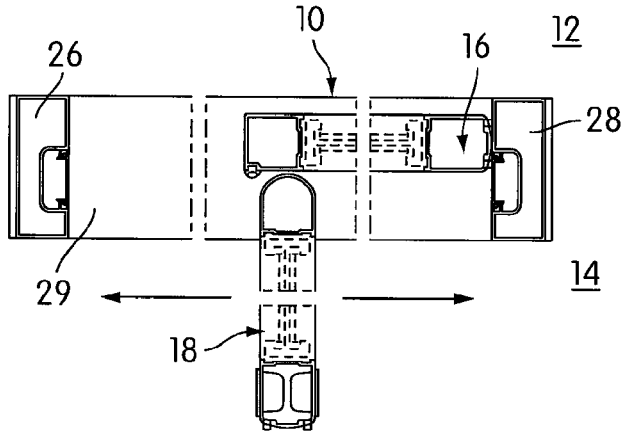
FIG. 15B is a cross sectional top view of the door assembly in the standard breakout position in accordance with an embodiment.
Figure 15C:
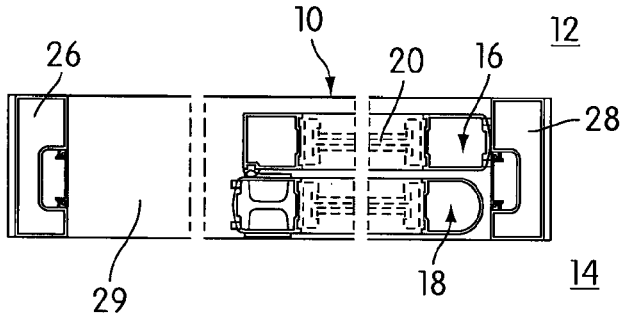
FIG. 15C is a cross sectional top view of the door assembly in the open position in accordance with an embodiment.
Figure 15D:
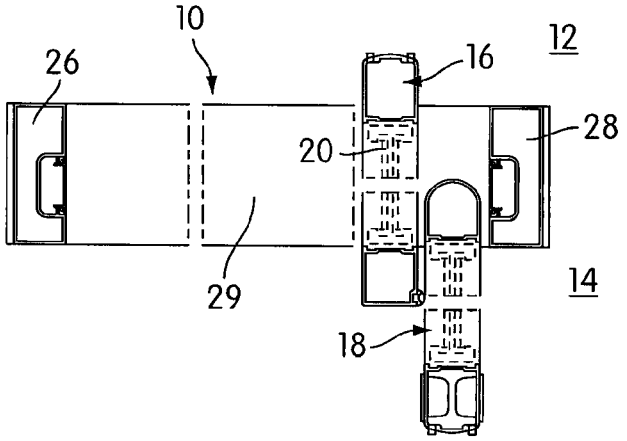
FIG. 15D is a cross sectional top view of the door assembly in the utility breakout position in accordance with an embodiment.

In the illustrated embodiment, the first pivot structure 20 and the third pivot structure 30 are provided on a jamb plate 98 extending from the second jamb 28. The first pivot structure 20 is positioned further away from the second jamb 28 than the third pivot structure 30. In one embodiment, the first pivot structure 20 may be positioned about three to four inches from the second jamb 28. In such embodiment, the third pivot structure 30 may be positioned about one to two inches from the second jamb 28. Such configuration of the first pivot structure 20 and the third pivot structure 30 enables the slideable door panel 18 and the normally fixed door panel 16 to pivot towards the second side 14 during the utility breakout configuration (as shown in FIG. 15*d*). That is, the location of the first pivot structure 20 enables the normally fixed door panel 16 to pivot to the utility breakout configuration without any obstruction by the slideable door panel 18 when the slideable door panel 18 is engaged with the third pivot structure 30. In such embodiments, to enable the normally fixed door panel 16 to be able to pivot via the first pivot structure 20, the slideable door panel 18 should in a predetermined orientation such that the slideable door panel 18 is positioned wherein the pivot engaging structure 72 or the second pivot structure 22 is located closer to the second jamb 28 than the first pivot structure 20. That is, the slideable door panel 18 should be slid substantially towards the second jamb 28 to enable the normally fixed door panel 16 to pivot. In such positions, the slideable door panel 18 does not impede the pivotal movement of the normally fixed door panel 16. In one embodiment, the door assembly 10 is constructed and arranged such that the normally fixed door panel 16 may pivot when the pivot engaging structure 72 and/or the second pivot structure 22 of the slideable door panel 18 is slid past the first pivot structure 20 associated with the normally fixed door panel 16 when the slideable door panel 18 is being slid to the open position. Alternatively, in one embodiment, the door assembly 10 is constructed and arranged such that the normally fixed door panel 16 may only pivot when the pivot engaging structure 72 of the slideable door panel 18 is engaged with the third pivot structure 30 and the slideable door panel 18 is also pivoted. Because the normally fixed door panel 16 may only breakout when the slideable door panel 18 breaks out, such arrangements may prevent the accidental breakout of the normally fixed door panel 16.

Figure 8A:
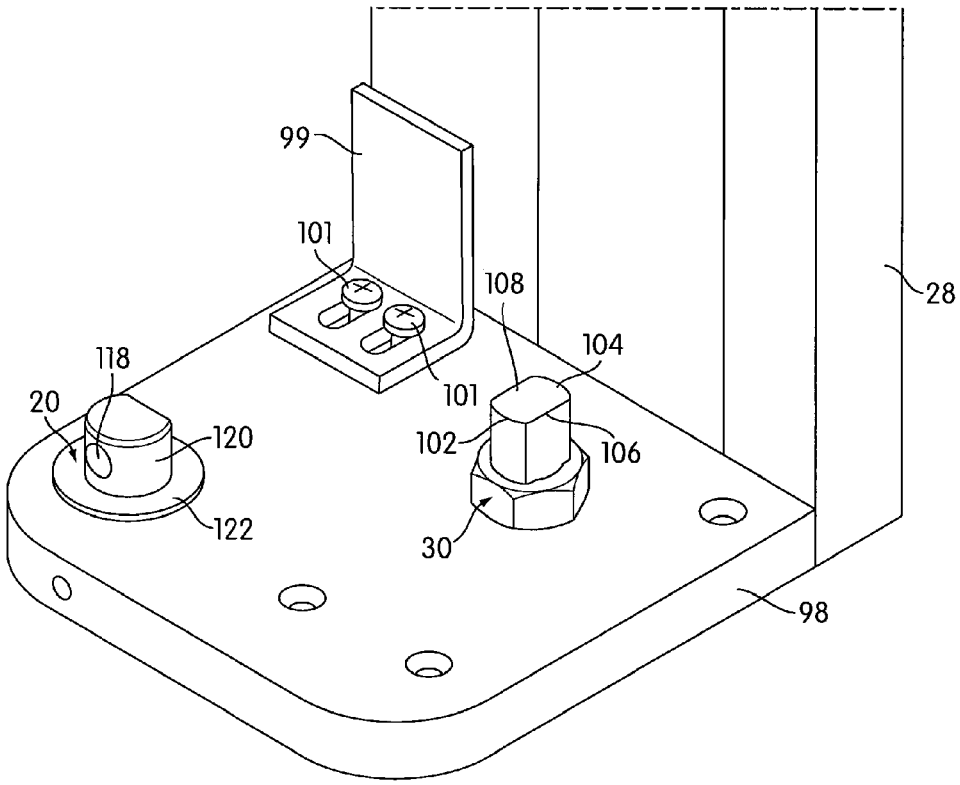
FIGS. 8A-8C show components of the door assembly enabling the door assembly to move to the utility breakout position in accordance with an embodiment.

In the embodiment shown in FIG. 7, the pivot engaging structure 72 includes a recess 100 constructed and arranged to receive the third pivot structure 30 during engagement thereof. The recess 100 may be hexagonal, circular, or may have other shapes. The pivot engaging structure 72 also includes an opening 110 in communication with the recess 100. The opening 110 is constructed and arranged to enable the third pivot structure 30 to be inserted and/or removed from the recess 100. The pivot engaging structure 72 may be attached to the pivot stile 50 of the slideable door panel 18 via a screw 112 (see FIG. 8C).

In one embodiment, the slideable door panel 18 includes the pivot engaging structure 72 constructed and arranged to engage with the third pivot structure 30. The third pivot structure 30 may take the form of a pivot pin. In the embodiment shown in FIG. 8A, the third pivot structure 30 has a generally rectangular configuration with curved first and second opposing sides 102, 104 and third and fourth opposing sides 106, 108. The first and second opposing sides 102, 104 may be shorter in length than the third and fourth opposing sides 106, 108. In this embodiment, the third pivot structure 30 is arranged such that the second side 104 faces the second jamb 28. As such, the third pivot structure 30 is positioned such that its narrower portion (defined by the first and second surfaces 102, 104) is aligned with the opening 110 of the pivot engaging structure 72 for insertion into the recess 100 of the pivot engaging structure 72. When the slideable door panel 18 is pivoted during utility breakout, the pivot receiving structure 72 is pivoted around the third pivot structure 30 such that its narrower portion is no longer aligned with the opening 110. As such, the third pivot structure 30 is retained within the recess 100 of the pivot engaging structure 72. This arrangement may stabilize the slideable door panel 18 during utility breakout and may prevent any excessive sideway, forward, or backward motion of the slideable door panel 18, thus only allowing for pivotal movement. It is contemplated, however, that the pivot engaging structure 72 and the third pivot structure 30 may have other configurations or locations in other embodiments.

Figure 8B:
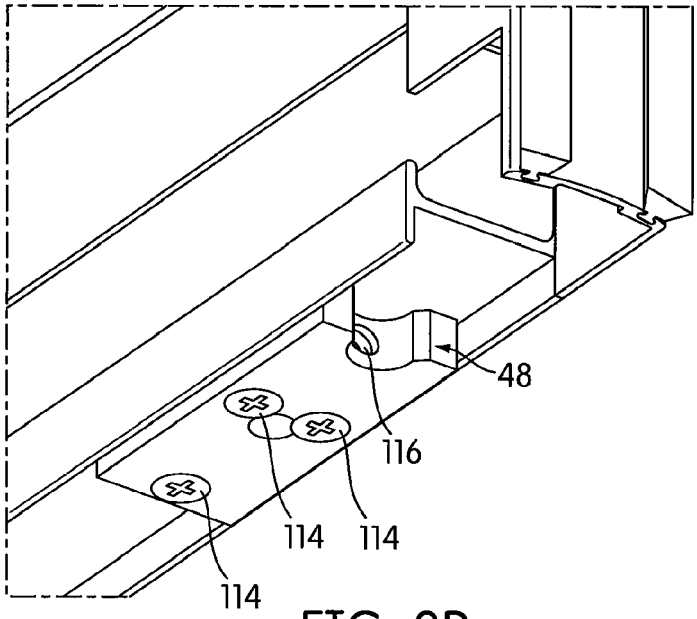
Figure 8C:
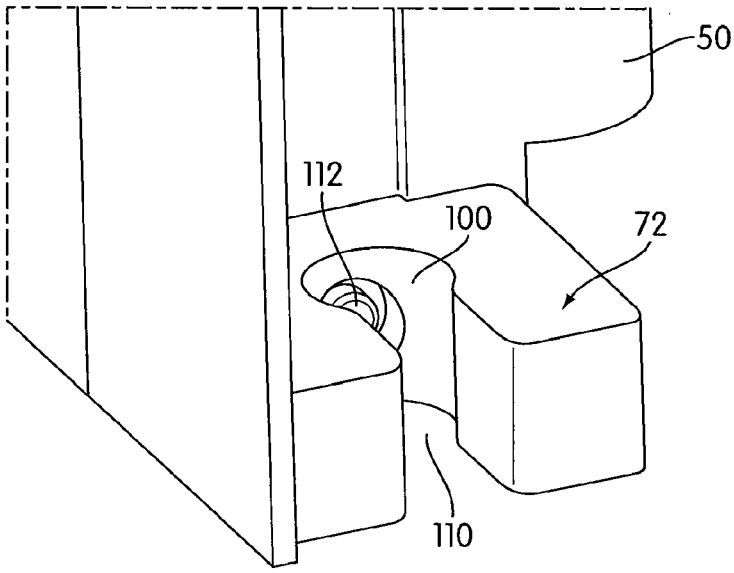

Referring back to the embodiment shown in FIG. 7, the normally fixed door panel 16 includes the pivot engaging structure 48 mounted therein via screws 114. As shown in FIG. 8B, the pivot engaging structure 48 may include a protrusion 116 constructed and arranged to engage with an opening 118 (see FIG. 8A) provided in the first pivot structure 20. It should be appreciated, however, that the pivot engaging structure 48 and the first pivot structure 20 may be engaged using other mechanisms. In some embodiments, bolts, screws, or other attachment mechanisms may be used to reinforce the engagement and to prevent accidental breakaways. In one embodiment, an upper portion 120 (see FIG. 8A) of the first pivot mechanism 20 may be pivotable or rotatable with respect to a lower portion 122 (see FIG. 8A) of the first pivot mechanism 20 that is fixed to the jamb plate 98. Accordingly, the engagement of the pivot engaging structure 48 of the normally fixed door panel 16 with the upper portion 120 enables pivotal movement of the normally fixed door panel 16. A bracket 99 may be constructed and arranged to facilitate the connection between the jamb plate 98 and the door jamb 28. Screws 101 or other attachment mechanisms may be used to attach the bracket 99 to the door jamb 28.

Figure 9:
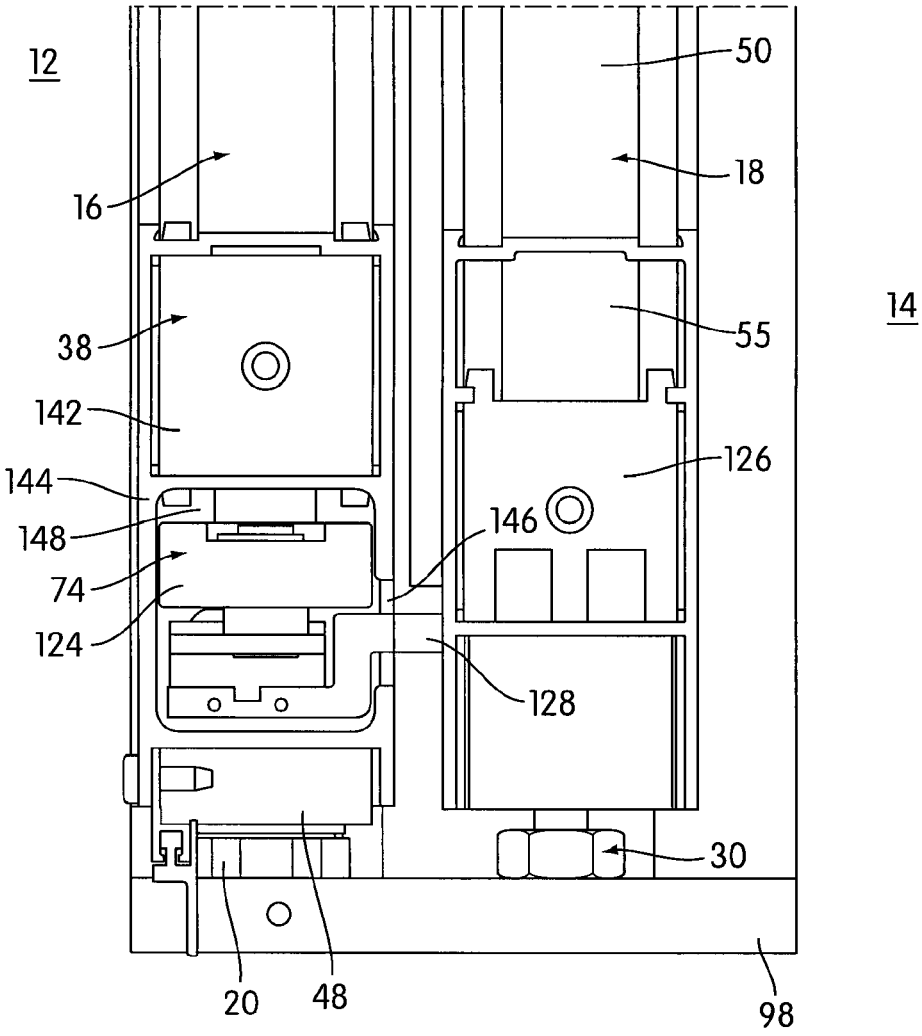
FIG. 9 shows a cross sectional side view of components of the slideable door panel and the normally fixed door panel in accordance with an embodiment.

FIG. 9 shows a cross sectional side view of a lower portion of the door assembly 10. As shown in FIG. 9, the normally fixed door panel 16 is pivotally mounted on the first pivot structure 20 via the pivot engaging structure 48 that is fixed to the normally fixed door panel 16. In this embodiment, the pivot engaging structure 72 (obstructed from view in this Figure) of the slideable door panel 18 is engaged with the third pivot structure 30. Accordingly, in such position, the normally fixed door panel 16 and the slideable door panel 18 may be pivoted to the utility breakaway configuration.

Figure 10A:
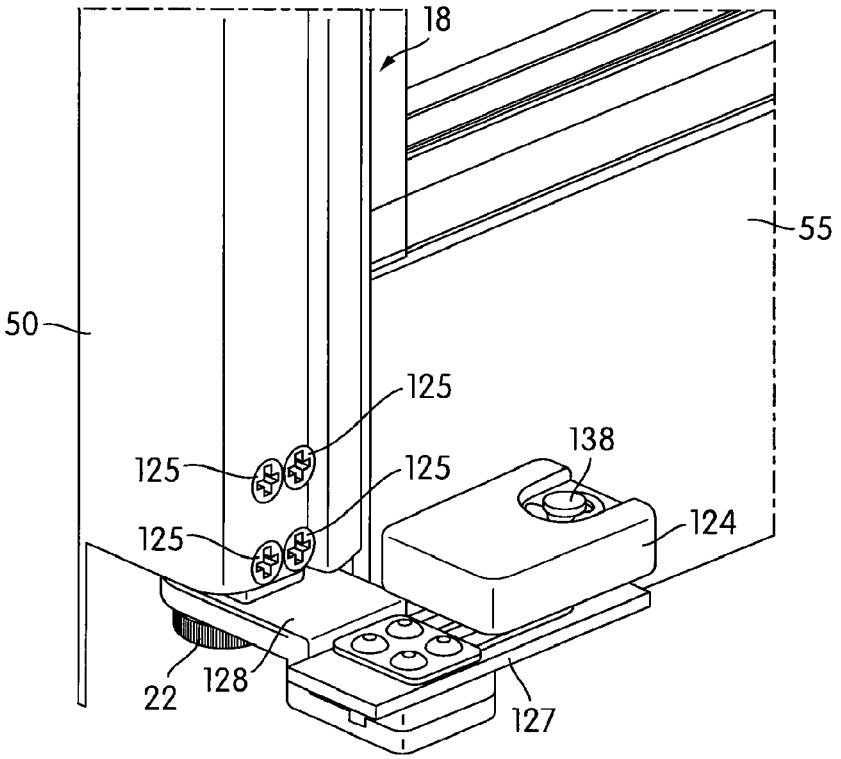
FIGS. 10A-10B are perspective views of a connector structure of the door assembly in accordance with an embodiment.
Figure 10B:
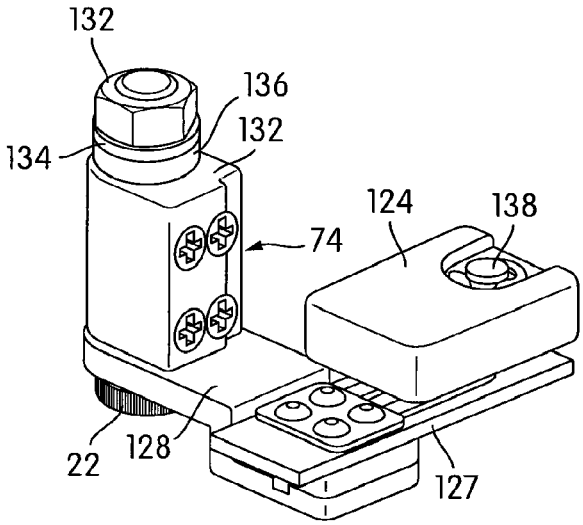

In the embodiment shown in FIG. 10A, the connector structure 74 has a sliding portion 124 constructed and arranged to be received in the normally fixed door panel 16, a fixed portion 126 constructed and arranged to be fixed to the slideable door panel 18, and a connecting portion 128 constructed and arranged to connect the fixed portion 126 and the sliding portion 124. The sliding portion 124 is provided on a support structure 127 connected to the connecting portion 128. The connecting portion 128 is provided between the spaced-apart normally fixed door panel 16 and the slideable door panel 18 to maintain a minimum distance therebetween.

Figure 10C:
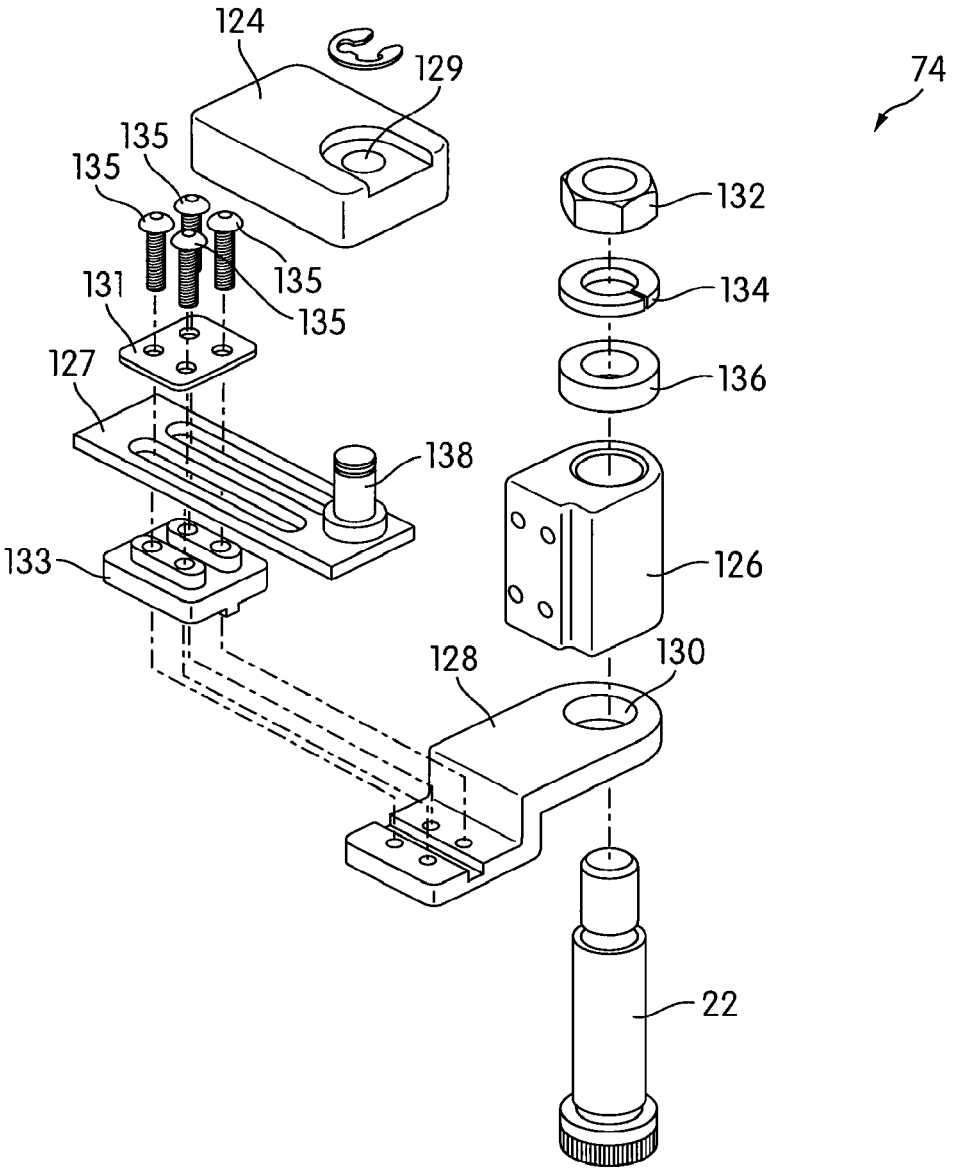
FIG. 10C is an exploded view of the connector structure in accordance with an embodiment.

In one embodiment, the fixed portion 126 is fixed to the pivot stile 50 of the slideable door panel 18 via screws 125. The second pivot structure 22, taking the form of a screw or shaft in this embodiment, is inserted through an opening 130 (see FIG. 10C) in the connecting portion 128 and received in the fixed portion 126. As shown in FIG. 10C, a nut 132 and washers 134, 136 may be provided to retain the second pivot structure 22 within the fixed portion 126. The slideable door panel 18 may pivot via the arrangement between the connecting portion 128 and the second pivot structure 22. A pin 138 may be provided to mount the sliding portion 124 on the support structure 127. However, other attachment mechanisms may be used. The sliding portion 124 may include an opening 129 constructed and arranged to receive the pin 138. At least a portion of the support structure 127 may be received between an upper attachment portion 131 and a lower attachment portion 133. Screws 135 may be inserted into openings in the upper and lower attachment portions 131, 133 and the connecting portion 130 to connect the support structure 127 to the connecting portion 128. Furthermore, the configurations described above are not intended to be limiting, and it is contemplated that the connector structure 74 may have other configurations.

Figure 11:
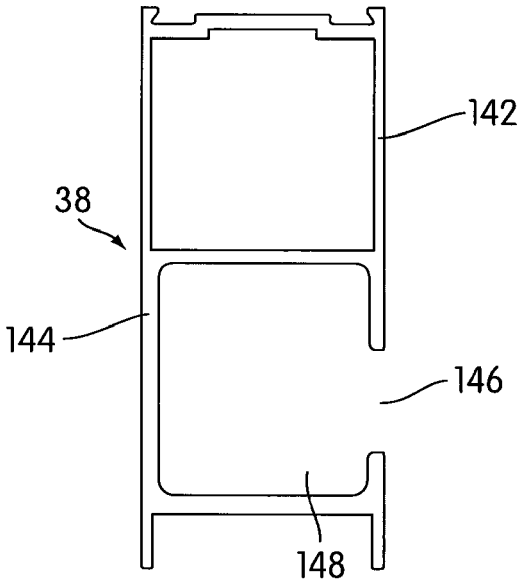
FIG. 11 is a cross sectional side view of a lower rail of the normally fixed door panel in accordance with an embodiment.

Referring back to FIG. 9, the sliding portion 124 of the connector structure 74 is received in the lower rail 38 of the normally fixed door panel 16. FIG. 11 shows a cross section of the lower rail 38. As shown in FIG. 11, the lower rail 38 has a generally hollow upper portion 142 and a generally hollow bottom portion 144 having an interior space 148 therein. The bottom portion 144 is provided with an elongated slot 146 constructed and arranged to communicate with the interior space 148. The slot 146 is arranged such that the slot 146 faces the slideable door panel 18 when the slideable door panel 18 and the normally fixed door panel 16 are in a substantially overlapping configuration. Referring back to FIG. 9, the sliding portion 124 is received within the interior space 148 of the lower portion 144 of the normally fixed door panel 16. At least a portion of the connecting portion 128 is received in the slot 146 such that the connecting portion 128 and the sliding portion 124 may slide horizontally partially within the normally fixed door panel 16. As mentioned above, the connecting portion 128 is attached to the fixed portion 126, which is fixed to the slideable door panel 18. Accordingly, during the sliding movement of the door panel 18 between the open and closed positions, the sliding portion 126 and a portion of the connecting portion 128 may slide within the normally fixed door panel 16. This configuration may facilitate and guide the sliding movement of the slideable door panel 18.

In the illustrated embodiment, the second pivot structure 22 and the connecting portion 128 of the connector structure 128 enables the slideable door panel 18 to be pivotable when the normally fixed door 16 is in the normally fixed position. During pivotal movement of the slideable door panel 18 towards the standard breakout position, the fixed portion 126 may pivot with the slideable door panel 18 via the shaft 22. For example, in the embodiment shown in FIG. 10A, the slideable door panel 18 may be pivoted in the counterclockwise direction towards the standard breakout configuration via the arrangement between the connecting portion 128 and the second pivot structure 22. That is, the positioning of the connecting portion 128 on the second pivot mechanism 22 enables the fixed portion 126 (and thus the slideable door panel 18) to pivot relative to the connecting portion 128. In one embodiment, the pivotal displacement of the fixed portion 126 may be limited to limit the pivoting movement of the slideable door panel 18. For example, in one embodiment, the pivotal movement of the slideable door panel 18 may be limited between 80° to 100° (for example, 90°) from its first (unpivoted) position. But in other embodiments, the slideable door panel 18 may be limited to other degrees or may not be limited at all.

Figure 17A:
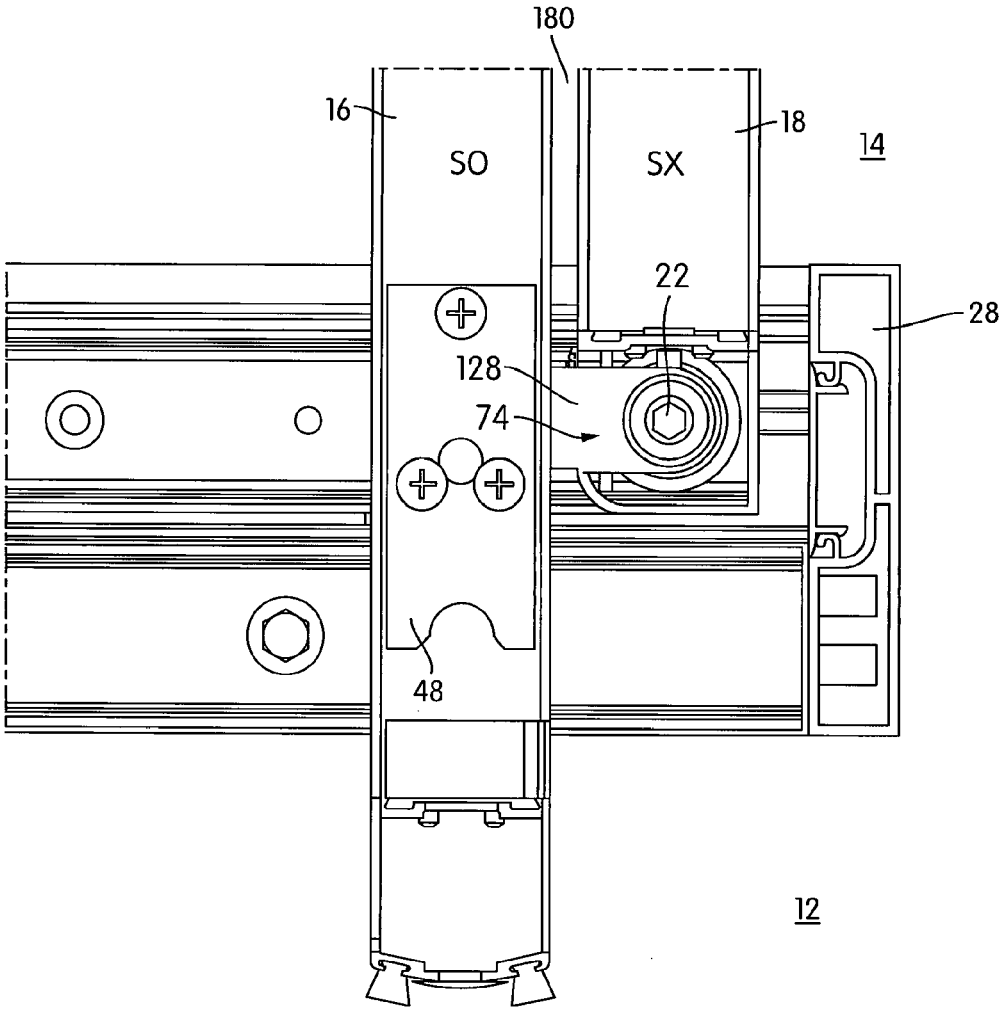
FIGS. 17A-17B show arrangements of the slideable door panel and the normally fixed door panel in the utility breakout configuration.
Figure 17B:
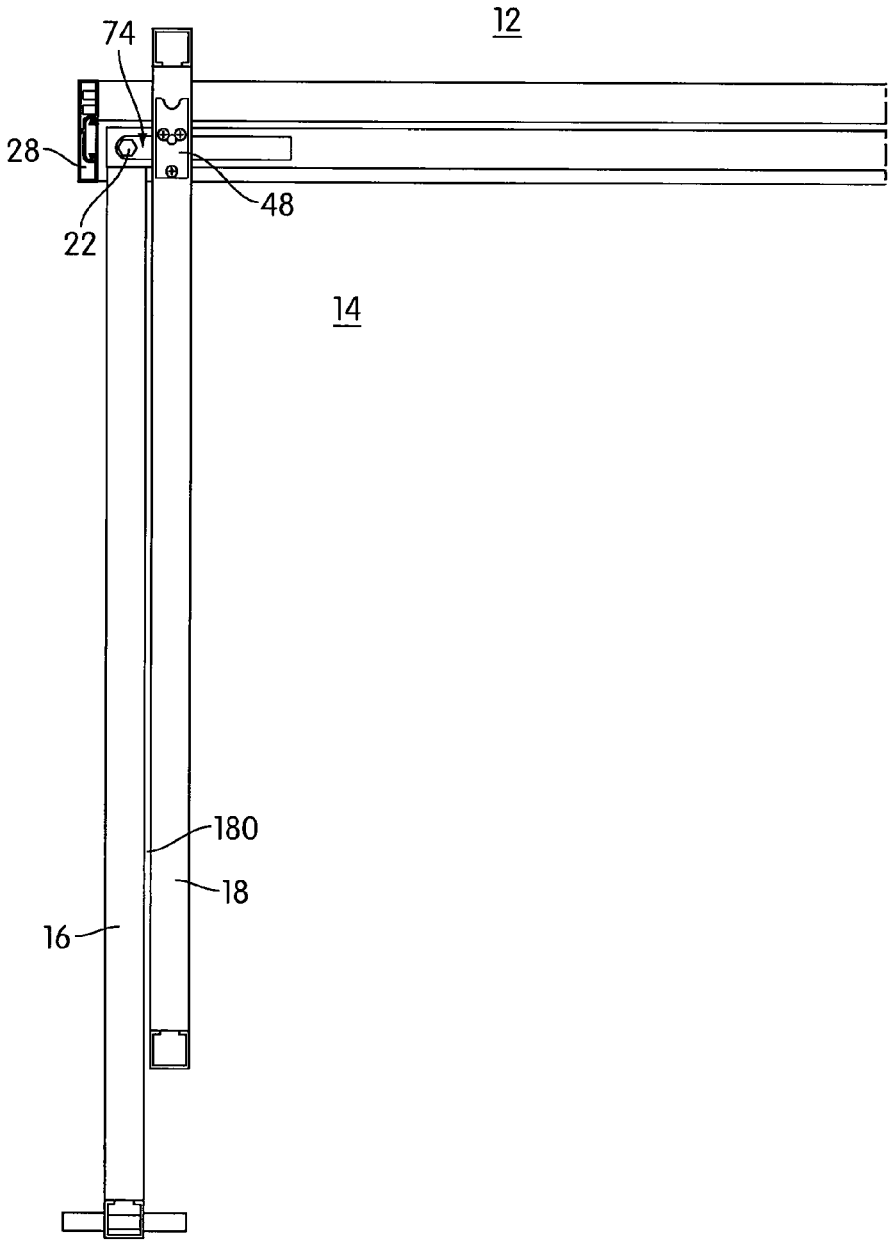

Furthermore, the connector structure 74 may be constructed and arranged to prevent the slideable door panel and the normally fixed door panel 16 from being spaced less than a predetermined minimum distance apart (and thus from contacting each other) during utility breakout. As shown in FIG. 17A, the normally fixed door panel 16 and the slideable door panel 18 may be positioned with a space 180 therebetween. In one embodiment, the space 180 cannot have a width (defined as the shortest distance between the slideable door panel 18 and the normally fixed door panel 16) less than the predetermined minimum distance. Accordingly, the slideable door panel 18 and the normally fixed door panel 16 cannot be positioned less than the predetermined minimum distance from each other (i.e., cannot be closer to each other than the predetermined distance). In the embodiment shown in FIG. 17B, when the slideable door panel 18 and the normally fixed door panel 16 are in the utility breakout configuration, the slideable door panel 18 and the normally fixed door panel 16 are spaced apart with the space 180 therebetween. In such embodiment, the space 180 has a width of the predetermined minimum distance and the slideable door panel 18 and the normally fixed door panel 16 cannot be moved closer towards each other to decrease the width of the space 180. That is, the slideable door panel 18 and the normally fixed door panel 16 are spaced at least the predetermined minimum distance apart. In one embodiment, the predetermined minimum distance is 0.2 inches (i.e., the slideable door panel 18 and the normally fixed door panel 16 are at least 0.2 inches apart). In one embodiment, the predetermined minimum distance is 0.3 inches (i.e., the slideable door panel 18 and the normally fixed door panel 16 are at least 0.3 inches apart). In one embodiment, the predetermined minimum distance is 0.4 inches (i.e., the slideable door panel 18 and the normally fixed door panel 16 are at least 0.4 inches apart). However, this predetermined minimum distance may vary in other embodiments. It should also be appreciated that the slideable door panel 18 and the normally fixed door panel 16 may be spaced apart at more than the predetermined minimum distance during utility or standard breakout because of the capability of the slideable door panel 18 to pivot independently of the normally fixed door panel 16.

In one embodiment, the connecting portion 128 of the connector structure 74 may be constructed and arranged to maintain the predetermined minimum distance between the slideable door panel 18 and the normally fixed door panel 16. Additionally, the pivotal movement of the fixed portion 126 (which is fixed to the slideable door panel 18) of the connector structure 74 may be limited with respect to the sliding portion 124 (which is received in the normally fixed door panel 16) to maintain the predetermined minimum distance between the slideable door panel 18 and the normally fixed door panel 16 during utility breakout. Accordingly, the predetermined minimum distance between the slideable door panel 18 and the normally fixed door panel 16 may prevent the slideable door panel 18 and the normally fixed door panel 16 from banging against each other during utility breakout and may also prevent objects, such as a user's fingers, from being caught between the slideable door panel 18 and the normally fixed door panel 16.

Figure 12:
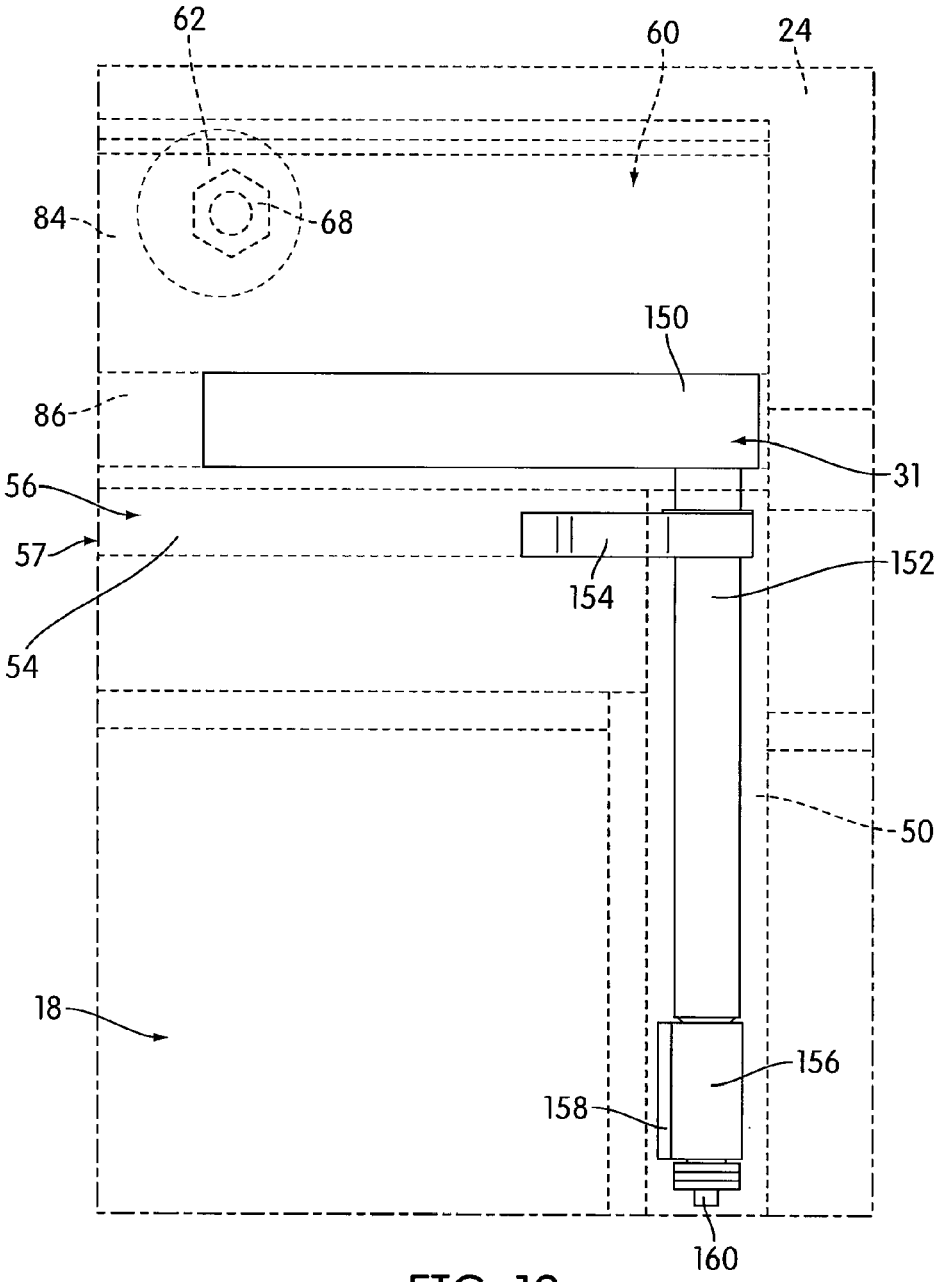
FIG. 12 shows a fourth pivot structure of the slideable door panel in accordance with an embodiment.
Figure 13B:
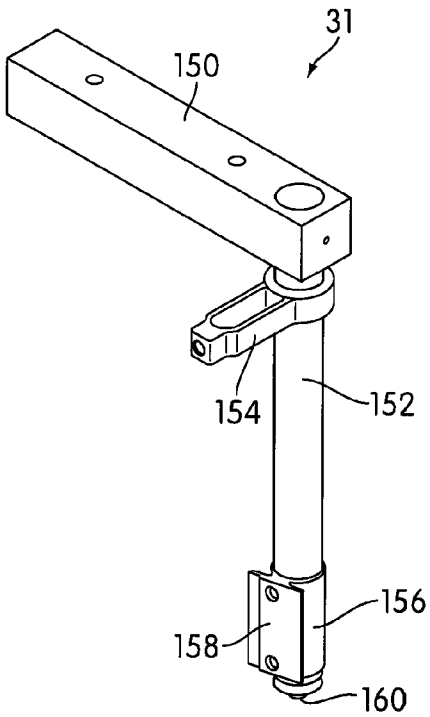
FIGS. 13A-13B show the fourth pivot structure of the slideable door panel in accordance with an embodiment.
Figure 13A:
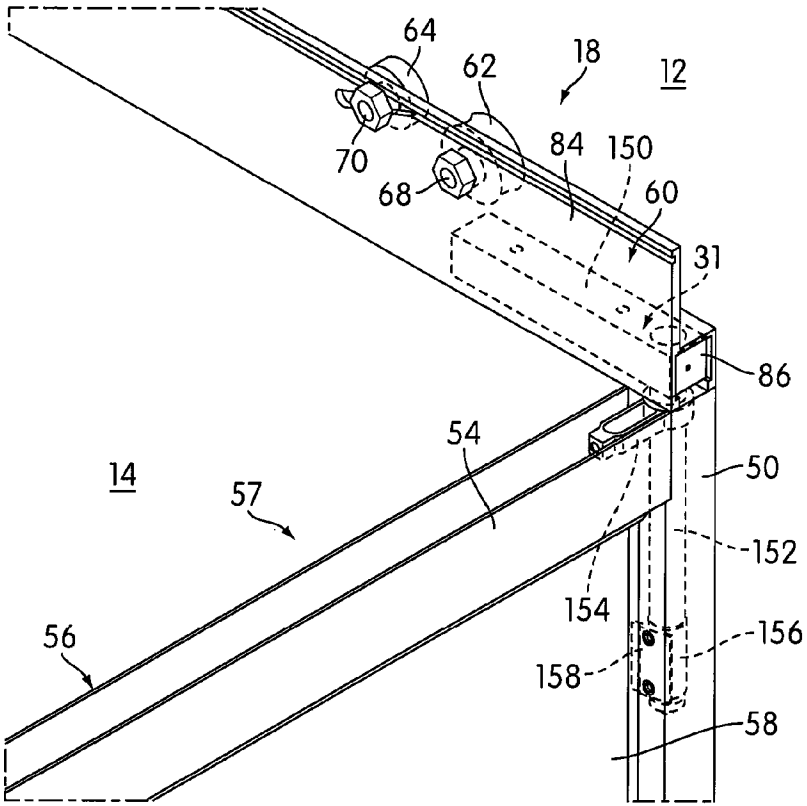

FIG. 12 illustrates the fourth pivot structure 31 in more detail. As mentioned above, the fourth pivot structure 31 is associated with the slideable door panel 18 and is operable with either the second pivot structure 22 or the third pivot structure 30 to enable pivotal movement of the slideable door panel 18. In the illustrated embodiment, the fourth pivot structure 31 includes an upper portion 150 constructed and arranged to be received in the interior space 88 (see FIG. 6) of the hanger 60. The fourth pivot structure 31 also includes a lower portion 152 substantially perpendicular to the upper portion 150 and constructed and arranged to be received in the pivot stile 50 of the slideable door panel 18. In this embodiment, the lower portion 152 takes the form of a shaft. The fourth pivot structure 31 also includes an extending adjuster portion 154 extending substantially parallel to the upper portion 150 and constructed and arranged to be received in the upper rail 54. A pillow block 156 extends from the lower portion 152 and is mounted in the pivot stile 50. The pillow block 156 is constructed and arranged to provide support for the lower portion 152 and to help retain the lower portion 152 in the pivot stile 50. In the illustrated embodiment, the pillow block 156 has an extending flange portion 158 and a pin 160 to facilitate the mounting of the pillow block 156 in the pivot stile 50. The pivot structure 31 may be made of metal (e.g., cast iron or pressed steel), wood, plastic, other materials, or a combination thereof. As shown in FIG. 13B, the extending adjuster portion 154 and the pillow block 156 are pivotable with respect to the upper portion 150. When the slideable door panel 18 is pivoted either during standard breakout or utility breakout, the pivoted portion 57, which includes the frame 56 and the sheet of material 58, is pivoted towards the second side 14 using the fourth pivot structure 31 and either the second pivot structure 22 or the third pivot structure 30 (described above). As shown in FIG. 13A, the pivoting of the pivot portion 57 of the slideable door panel 18 may cause the extending adjuster portion 154 to pivot with the upper rail 54 and the flange 158 of the pillow block 156 to pivot with the pivot stile 50. During the pivoting movement, the upper portion 150 may remain stationary in the hanger 60.

Figure 14:
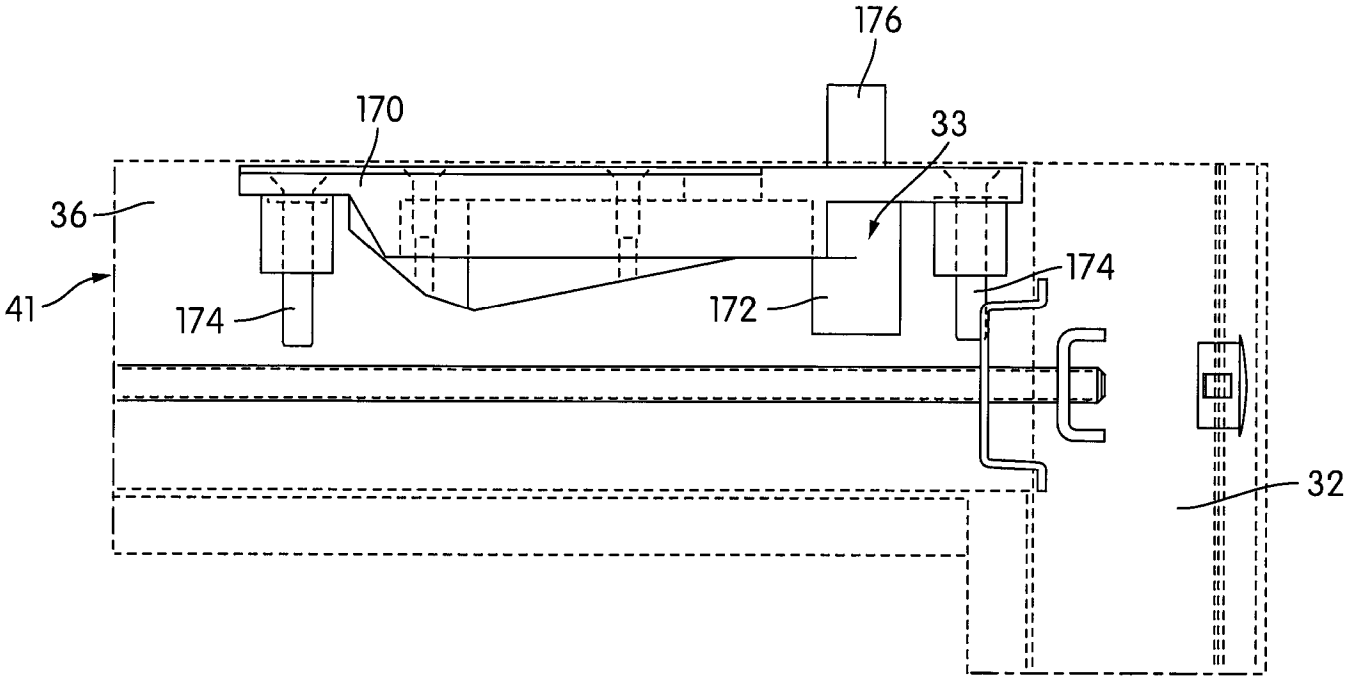
FIG. 14 shows a fifth pivot structure of the normally fixed door panel in accordance with an embodiment.

FIG. 14 shows the fifth pivot structure 33 in more detail. As mentioned above, the fifth pivot structure 33 is associated with the normally fixed door panel 16 and is operable with the first pivot structure 20 to enable pivotal movement of the normally fixed door panel 16 during utility breakout. The fifth pivot structure 33 may be located between the leading stile 34 and the pivot stile 32 of the normally fixed door panel 16, and may be located closer to the pivot stile 32 than to the leading stile 34. In one embodiment, the fifth pivot structure 33 may be vertically aligned with the first pivot structure to enable pivotal movement of the normally fixed door panel 16. In the illustrated embodiment, the fifth pivot structure 33 includes an extending portion 170 constructed and arranged to be received in the upper rail 36 and a vertical portion 172 constructed and arranged to extend generally perpendicular from the extending portion 170. However, it is contemplated that the vertical portion 172 may be arranged to extend from the extending portion 170 at other angles in other embodiments. The extending portion 170 may be mounted to the upper rail 36 using screws 174, although it is contemplated that other attachment mechanisms may be used. The fifth pivot structure 33 is also provided with a protruding portion 176 constructed and arranged to extend from the top thereof into the fixed rail 94 (not shown in this Figure). The protruding portion 176 may be part of a shaft or other connector structure received in the vertical portion 172, thus enabling the extending portion 170 to pivot relative to the protruding portion 176. The connections between the fixed rail 94 and the fifth pivot structure 33 and between the fifth pivot structure 33 and the upper rail 36 enable the pivot portion 41 of the normally fixed door panel 16 to pivot relative to the fixed rail 94. That is, when the normally fixed door panel 16 is pivoted during utility breakout, the upper rail 36 pivots away from the fixed rail 94.

The door assembly 10 may be moved to the utility breakout configuration as follows in accordance with an embodiment. The slideable door panel 18 may initially be in the closed position, as shown in FIGS. 15A and 1A wherein passage between the first side 12 and the second side 14 is prevented. As shown in FIG. 15A, the normally fixed door panel 16 may be positioned closer than the slideable door panel 18 to the first side 12, and the slideable door panel 18 may be positioned closer than the normally fixed door panel 16 to the second side 14. As such, the slideable door panel 18 is arranged to prevent the breakout of the normally fixed door panel 16, thus preventing unintentional breakout of the normally fixed door panel 16.

To enable passage through the opening 29 between the first side 12 and the second side 14, the user may slide the slideable door panel 18 towards the normally fixed door panel 16 to the open position using the handle 76 or 78. As mentioned above, the wheels 62 mounted on the hanger 60 and the track 90 enable the slideable door panel 18 to slide between the open and closed positions. The connector structure 74 may help guide the sliding movement of the slideable door panel 18 relative to the normally fixed door panel 16.

In one embodiment, when the user slides the slideable door panel 18 towards the open position (see FIG. 15C and FIG. 1B), the slideable door panel 18 may be moved to the predetermined orientation wherein the second pivot structure 22 and/or the pivot receiving structure 72 of the slideable door panel 18 are slid past the first pivot structure 20 associated with the normally fixed door panel 16. In the predetermined orientation, the normally fixed door panel 16 may be pivoted because the slideable door panel 16 is no longer obstructing the pivotal movement of the normally fixed door panel 16. When the slideable door panel 18 is in the open position, the pivot receiving structure 72 of the slideable door panel 18 may then be engaged with the third pivot structure 30 (see FIG. 7). Referring to FIG. 15C, the slideable door panel 18 may then be pivoted towards the second side 14 in the counterclockwise direction. In one embodiment, the slideable door panel 18 is pivoted to the utility breakout configuration using the fourth pivot structure 31 and the third pivot structure 30. The normally fixed door panel 16 may also be pivoted towards the second side 14 in the counterclockwise direction. The normally fixed door panel 16 may be pivoted using the first pivot structure 20 and the fifth pivot structure 33. As such, the slideable door panel 18 and the normally fixed door panel 16 may be pivoted to the utility breakout configuration shown in FIGS. 1C and 15D. It should be appreciated that the slideable door panel 18 may pivot independently of the normally fixed door panel 16 or may simultaneously pivot with the normally fixed door panel 16. In contrast, in this embodiment, the normally fixed door panel 16 may only pivot when the slideable door panel 18 has been pivoted during utility breakout. During pivotal movement of the slideable door panel 18 and the normally fixed door panel 16 to the utility breakout configuration, the connector structure 74 maintains a minimum distance between the slideable door panel 18 and the normally fixed door panel 16 to prevent objects (e.g., fingers) from being pinched therebetween.

The door assembly 10 may be moved to the standard breakout configuration as follows in accordance with an embodiment. The slideable door panel 18 may initially be in the closed position, as shown in FIGS. 15A and 1A wherein passage between the first side 12 and the second side 14 is prevented. As shown in FIG. 15A, the normally fixed door panel 16 is positioned closer than the slideable door panel 18 to the first side 12, and the slideable door panel 18 is positioned closer than the normally fixed door panel 16 to the second side 14. This configuration enables the slideable door panel 18 to be pivoted to the standard breakout configuration at any position during sliding movement between the open and closed positions (see, for example, FIGS. 2B and 15B).

When the slideable door panel 18 is in the closed position shown in FIG. 15A, the handle may be disengaged and the slideable door panel 18 may be pivoted to the standard breakout configuration. Alternatively, the slideable door panel 18 may be slid towards the open position and may be pivoted to the standard breakout configuration along the way. As mentioned above, the wheels 62 mounted on the hanger 60 and the track 90 enable the slideable door panel 18 to slide between the open and closed positions. The connector structure 74 guides the sliding movement of the slideable door panel 18 relative to the normally fixed door panel 16. When the slideable door panel 18 is to be pivoted to the standard breakout configuration from the first (unpivoted) position, the slideable door panel 18 may be pivoted towards the second side 14 using the second pivot structure 22 and the fourth pivot structure 31. In some embodiments, when the slideable door panel 18 is in the standard breakout configuration (see FIG. 2B), the slideable door panel 18 may be slid towards the pivot stile 32 of the normally fixed door panel 16 without moving the slideable door panel 18 back to the first (unpivoted) position. In one embodiment, during the standard breakout of the slideable door panel 18, the slideable door panel 18 cannot be slid onto the third pivot structure 30 mounted in the jamb plate 98. In one embodiment, during the standard breakout, the weight of the cantilevered slideable door panel 18 may be enough to hold the hanger 60 (with the pivotal portion 57 of the slideable door panel 18 connected thereto) in place. That is, in such embodiment, the slideable door panel 18 may not be slid once the slideable door panel 18 is in the standard breakout configuration because of the weight of the cantilevered slideable door panel 18. To move the slideable door panel 18 to the utility breakout configuration, the user may slide the slideable door panel 18 when the slideable door panel 18 is in the first (unpivoted) position towards the jamb plate 98 such that the pivot receiving structure 72 of the slideable door panel 18 may engage with the third pivot structure 30. Accordingly, the user may then breakout both the slideable door panel 18 and the normally fixed door panel 16.

Figure 16A:
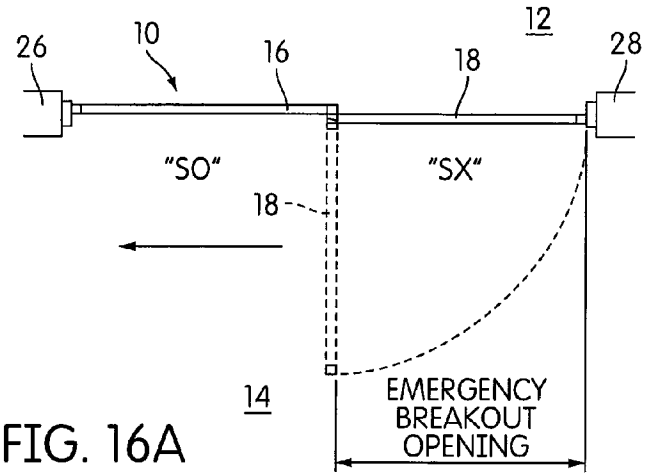
FIG. 16A-16B illustrate a left configuration door assembly in accordance with an embodiment.
Figure 16C:
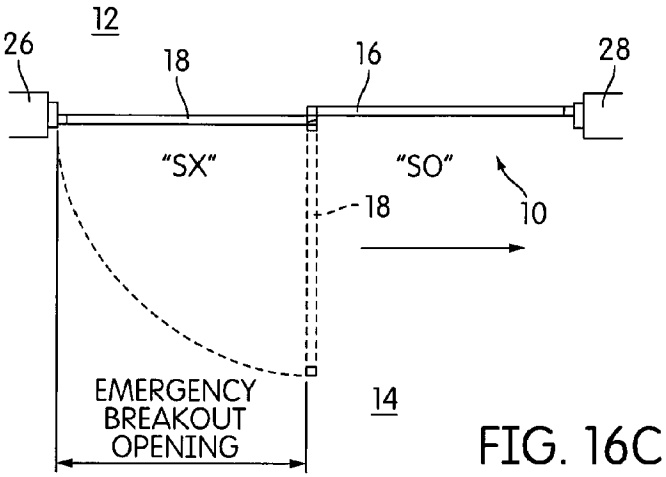
FIGS. 16C-16D illustrate a right configuration door assembly in accordance with an embodiment.
Figure 16B:
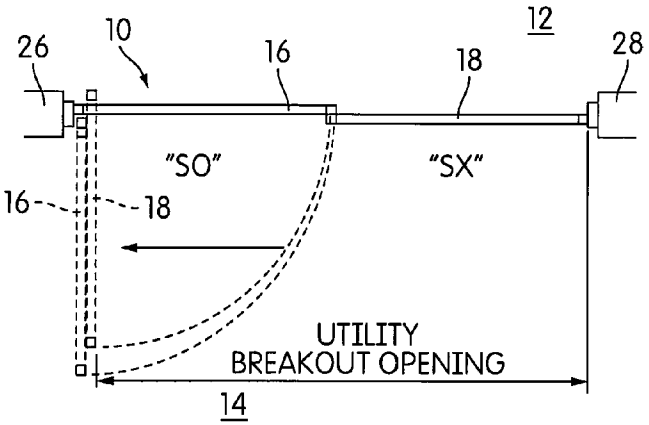
Figure 16D:
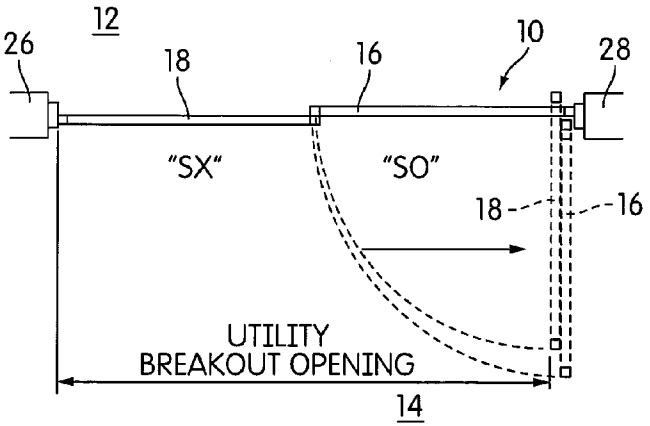

Although the door assembly 10 described above has a right configuration (see FIGS. 16C-16D) wherein the pivot stiles 32, 50 of the normally fixed door panel 16 and the slideable door panel 18, respectively, are positioned closer to the second jamb 28 during utility breakout, it should be appreciated that the door assembly 10 may also have a left configuration (see FIGS. 16A-16B) wherein the pivot stiles 32, 50 of the normally fixed door panel 16 and the slideable door panel 18, respectively, are positioned closer to the first jamb 26 during utility breakout. In other words, the positioning of the slideable door panel 18 and the normally fixed door panel 16 with respect to the first and second door jambs 26, 28 may be interchangeable. However, it should be appreciated that in the embodiments shown in FIGS. 16A-16D, the slideable door panel 18 is positioned closer than the normally fixed door panel 16 to the second side 14 (e.g., the outside or the direction in which the slideable door panel 18 and the normally fixed door panel 16 pivot).

Although the invention has been described in detail for the purpose of illustration, it is to be understood that such detail is solely for that purpose and that the invention is not limited to the disclosed embodiments, but, on the contrary, is intended to cover modifications and equivalent arrangements that are within the spirit and scope of the appended claims. In addition, it is to be understood that the present invention contemplates that, to the extent possible, one or more features of any embodiment can be combined with one or more features of any other embodiment.

What is claimed is:

1. A slideable and pivotable door assembly configured to selectively permit passage through an opening between a first side and a second side of the opening, the slideable and pivotable door assembly comprising:

a first door panel arranged to cover a first portion of the opening;

a slideable door panel constructed and arranged to be slideable, relative to the first door panel, the slideable door panel being slidable between a 1) closed position wherein the slidable door panel covers a second portion of the opening and 2) an open position wherein the second portion of the opening is uncovered;

a first pivot structure constructed and arranged to enable pivotal movement of the first door panel between a first position and a second position upon a pivoting actuation; and a second pivot structure constructed and arranged to enable pivotal movement of the slidable door panel while the first door panel remains in its position, wherein the slideable door panel is pivotally moveable towards the second side, and the slideable door panel and the first door panel are arranged such that the slideable door panel is positioned closer than the first door panel to the second side in the closed position.

2. The slideable and pivotable door assembly of claim 1, further comprising a third pivot structure being constructed and arranged to engage with the slideable door panel to facilitate pivotal movement of the slideable door panel.

3. The slideable and pivotable door assembly of claim 2, wherein the third pivot structure comprises a pivot pin.

4. The slideable and pivotable door assembly of claim 2, wherein the first door panel is operable to be pivoted away from its first position when the slideable door panel is engaged with the third pivot structure.

5. The slideable and pivotable door assembly of claim 2, further comprising a fourth pivot structure associated with the slideable door panel and operable with either the second pivot structure or the third pivot structure to enable pivotal movement of the slideable door panel.

6. The slideable and pivotable door assembly of claim 5, wherein the slideable door panel comprises a leading stile and a pivot stile, and wherein at least a portion of the fourth pivot structure is received in the pivot stile.

7. The slideable and pivotable door assembly of claim 1, further comprising a connector structure constructed and arranged to maintain a minimum distance between the slideable door panel and the first door panel when the slideable door panel and the first door panel are in a substantially overlapping configuration.

8. The slideable and pivotable door assembly of claim 7, wherein the slideable door panel is operatively connected to the connector structure.

9. The slideable and pivotable door assembly of claim 7, wherein the first door panel comprises an interior space constructed and arranged to receive at least a portion of the connector structure such that the slideable door panel is slideable relative to the first door panel.

10. The slideable and pivotable door assembly of claim 1, wherein the second pivot structure comprises a pivot pin.

11. The slideable and pivotable door assembly of claim 1, wherein the slideable door panel comprises a rolling structure constructed and arranged to facilitate the sliding of the slideable door panel between the open and closed positions.

12. The slideable and pivotable door assembly of claim 1, further comprising a fifth pivot structure associated with the first door panel and operable with the first pivot structure to enable pivotal movement of the first door panel.

13. The slideable and pivotable door assembly of claim 1, wherein the first door panel comprises a leading stile and a pivot stile, and wherein the fifth pivot structure is located between the leading stile and the pivot stile.

14. A slideable and pivotable door assembly configured to selectively permit passage through an opening between a first side and a second side of the opening, the slideable and pivotable door assembly comprising:

a first door panel having a first position, the first door panel arranged to cover a first portion of the opening when in the first position;

a slideable door panel constructed and arranged to be slidable relative to the first door panel, the slideable door panel being slideable between a 1) closed position wherein the slideable door panel covers a second portion of the opening and 2) an open position wherein the second portion of the opening is uncovered;

a first pivot structure constructed and arranged to enable pivotal movement of the first door panel when the slideable door panel is disposed at a predetermined orientation relative to the first door panel; and a second pivot structure constructed and arranged to enable pivotal movement of the slideable door panel at any slideable position of the slideable door panel between the closed position and the open position.

15. The slideable and pivotable door assembly of claim 14, wherein the slideable door panel and the first door panel are pivotally moveable towards the second side, and wherein the slideable door panel is disposed closer than the first door panel to the second side when the slideable door panel is in the closed position.

16. The slideable and pivotable door assembly of claim 14, wherein pivotal movement of the first door is enabled only during pivotal movement of the slideable door panel.

17. The slideable and pivotable door assembly of claim 14, further comprising a connector structure constructed and arranged to maintain a minimum distance between the slideable door panel and the first door panel when the slideable door panel and the first door panel are in at least a partially overlapping orientation.

18. The slideable and pivotable door assembly of claim 14, further comprising a third pivot structure being constructed and arranged to engage with the slideable door panel to facilitate pivotal movement of the slideable door panel.

19. The slideable and pivotable door assembly of claim 14, wherein the slideable door is operable to be disposed at the predetermined position relative to the first door panel by sliding the slideable door panel towards the open position such that the second pivot structure of the slideable door panel is slid past the first pivot structure of the first door panel.

20. The slideable and pivotable door assembly of claim 14, wherein the slideable door panel is in a substantially or completely overlapping orientation with the first door panel when the slideable door is in the open position.

* * * * *